US005103920A

United States Patent [19]

Patton

[11] Patent Number: 5,103,920

[45] Date of Patent: Apr. 14, 1992

[54] SURVEYING SYSTEM AND METHOD FOR LOCATING TARGET SUBTERRANEAN BODIES

[75] Inventor: Bob J. Patton, Dallas, Tex.

[73] Assignee: Patton Consulting Inc., Dallas, Tex.

[21] Appl. No.: 546,440

[22] Filed: Jun. 29, 1990

Related U.S. Application Data

[63] Continuation-in-part of Ser. No. 317,634, Mar. 1, 1989, Pat. No. 4,957,172.

[51] Int. Cl.[5] ..... E21B 7/04; E21B 47/022; G01V 3/08; G01V 3/26

[52] U.S. Cl. ..... 175/45; 175/50; 175/61; 324/346; 324/356; 324/369

[58] Field of Search ..... 175/61, 45, 40, 50; 324/346, 323, 338, 339, 355, 356, 357, 369, 351; 340/853; 33/302, 304; 166/250

[56] References Cited

U.S. PATENT DOCUMENTS

| | | | |
|---|---|---|---|
| 3,282,355 | 11/1966 | Henderson | 175/40 X |
| 4,372,398 | 2/1983 | Kuckes | 175/61 X |
| 4,443,762 | 4/1984 | Kuckes | 175/45 X |
| 4,480,701 | 11/1984 | Baldwin | 175/45 |
| 4,529,939 | 7/1985 | Kuckes | 166/250 X |
| 4,700,142 | 10/1987 | Kuckes | 175/45 X |

*Primary Examiner*—Stephen J. Novosad

[57] ABSTRACT

An improved system for use in drilling a relief well to intersect a target blowout well. A probable location distribution is used to survey the location of the candidate relief wells and the blowout well. Through the use of the relative probable location distribution, the integral probabilities of find, intercept and collision are calculated. A relief well plan is then optimally designed to drill and insure a high integral probability of a find and intercept and a low probability of a collision. The method provided by the present invention allows a relief well to be drilled in a minimum time with minimum risk exposure.

28 Claims, 18 Drawing Sheets

SURVEYING SYSTEM AND METHOD FOR LOCATING TARGET SUBTERRANEAN BODIES

CONTINUING DATA

This application is a continuation-in-part of application Ser. No. 07/317,634 filed Mar. 1, 1989, now U.S. Pat. No. 4,957,172.

FIELD OF THE INVENTION

The present invention relates generally to a method and apparatus for locating target subterranean bodies. More specifically, the present invention provides a method and apparatus for using a relative probable location distribution searching technique in order to locate and kill a blowout well in minimum time with minimum risk exposure.

BACKGROUND

As the easily exploited hydrocarbon energy sources have been depleted, oil and gas wells have been drilled to ever deeper depths and have required more complex technology. Much of the current drilling activity is conducted from off-shore drilling platforms which often support twenty or more wells. All but one of the wells drilled from such a platform are necessarily deviated from the vertical axis.

Oil and gas wells are drilled into a reservoir of oil or gas wherein the reservoir generally consists of a porous rock which is filled with hydrocarbon liquids, hydrocarbon gases, water, and sometimes other liquids and gases. The pressure in the reservoir is considered "normal" when it is equal to the pressure exerted by a column of water extending from the surface to the reservoir depth. Petroleum reservoirs are often over-pressured below certain depths and can be under-pressured when depleted.

When a well is drilled into a reservoir, the reservoir fluids tend to flow into the wellbore and up to the surface unless the pressure exerted by the column of fluid in the wellbore exceeds the reservoir fluid pressure. Well bore fluid weight is, therefore, extremely important in well control. A "blowout" is defined as a fluid flow from the reservoir which is not under control—either to the surface or to another underground reservoir.

Wells are normally drilled with a liquid in the wellbore called "mud" which is composed of either a water or oil phase carrier and solid components to give the mud viscosity and extra weight or pressure. Blowouts generally occur when the mud weight is too low (below reservoir pressure) due most often to too low a solids content or dilution by produced liquids, notably gas, which lowers the mud weight. Gas dilution blowouts are generally the worst because of the extreme lowering pressure and fire hazards.

Offshore platform blowouts are much harder to control than land blowouts due to the logistics and personal danger. There are typically about 160 reported blowouts per year, most of which are controlled within a few days largely by natural processes such as bridging. About thirty percent are controlled by surface capping and typically within thirty days. About five blowouts per year require relief wells to control.

The term "relief well" is a historical term and is actually a misnomer when applied to modern kill wells today. Until about 12 years ago when search methods were developed, relief wells had a very small chance of intersecting the blowout. Consequently, the "relief method" was used to control blowout wells. The relief method involves the drilling of multiple producing wells in the vicinity of the blowout to allow the production from these wells to "relieve" the reservoir pressure. Hence the term relief well.

As was mentioned above, until recently relief wells had a very small chance of intersecting a blowout because of inadequate search methods. Search methods are heavily dependent on accurate surveys of the relief wellbore. Two angles are used to describe the direction of a well: (1) inclination (often called drift angle) is the angle between the borehole and the vertical axis which is defined by gravity; (2) azimuth is the horizontal directional component of the well which is measured clockwise from true geographic north. Directional drillers often refer to the azimuth as the direction and use a quadrant system of notation such as N85:30E or S80:00E. These two directions are mostly east and 14½ degrees different. The equivalent azimuth statements are 85.5 and 100.0 degrees.

Wells which are deviated from the vertical axis are represented by maps or plots. There are two common views of a deviated well: (1) the plan or horizontal view which is a projection of the well path on the horizontal plane with North-South and East-West axis; and (2) the section view which is a projection of the well path of a vertical plane, usually a plane closest to the average horizontal direction of the well path. Deviated wells are also described by "build" and "drop" rates. The build and drop rates refer to the rate at which the inclination (or drift) is increased or decreased, respectively. The rates are normally quoted in degrees per hundred feet. Typical rates are 1–4 degrees per hundred feet. In addition, the rate of curvature of a deviated well is called "dogleg severity."

In the past, changes in azimuth or direction were not made except to "correct" the direction of a well which had deviated from the planned two dimensional course. Such corrections turn left or right and have the same rate restrictions as build or drop. Normally, build or drop corrections are not mixed with left and right corrections, but, are executed independently. Modern "bent housing" downhole motors make drilling in three dimensions more practical than drilling with the previous "bent sub" methods because of the greatly reduced length below the bend. Normal directional drilling is still basically two dimensional.

The surveying and drilling system provided by the present invention is fundamentally a three dimensional process which is extremely important for the drilling of relief wells. As will be discussed in greater detail below the invention planning system is capable of extreme precision in directing the relief well to an exact three dimensional target. The three dimensional quality generates less total curvature than previous surveying methods, thus representing a major improvement over the prior art. By contrast, state of the art directional drilling planning has previously been geared to hitting large targets usually greater than 100 feet across, which do not require precision planning.

Until approximately 1975, there were no surveying systems which were capable of providing an accurate quantitative measurement of the direction and distance to a blowout well from the well bore of the relief well. Until 1975, conventional wireline formation logging tools were used in relatively unsuccessful attempts to guide the relief well to the blowout well. The most successful systems used until that time were based on the Ulsel log, a long spaced resistivity log which was used in conjunction with special sonic detectors. The Ulsel log could be used to detect the blow out well casing, but provided a very poor range estimate and absolutely no directional information. Furthermore, the sonic detectors could detect the sound in the vicinity of high gas production and could detect the depth of the blowing formation, but provided very poor ranging and no directional information.

U.S. Pat. No. 4,072,200 issued Feb. 7, 1978, to Morris et al discloses a device for detecting the static magnetization of tubulars in a blowout well from a wireline tool in the relief well. This device has been used in approximately 90 previous cases wherein it was necessary to located a remote well. The device disclosed in the Morris patent, sometimes referred to as "MagRange TM", detects magnetic monopoles normally associated with tubular (either casing or drill collars) joints in the blowout wellbore. The occurrence and distribution of poles is virtually random, making the reliability of detection uncertain at a given joint and generally limited to the 30 or 40 foot joint spacing. The range from a joint is typically 25 feet but varies from virtually zero up to approximately 50 feet. The range from the end of the casing or drill pipe is much higher, on the order of 100 feet.

Another surveying technique, disclosed in U.S. Pat. No. 4,529,939 issued on July 16, 1985, to Kuckes, is based on an induction magnetic method. In the Kuckes method, alternating current (1 Hz) is injected into the earth from a wireline tool in the relief well. At the end of the wireline, typically 350 feet below the current injector, two vector magnetic sensors mounted mutually perpendicular to each other, and perpendicular to the borehole, synchronously (with the injected current) detect magnetic fields emanating from the blowout tubulars due to current having collected in the tubulars and flowing along the longitudinal axis of the respective tubulars. This method has a range of between 100 and 200 feet, depending on the resistivity of the formations. It also has an improved accuracy with respect to the determination of direction. The range estimate based on the Kuckes method has an approximate accuracy of between 20 and 50 percent, depending on the distance.

The two survey tools described above have significantly improved the art of drilling relief wells to intersect and kill a blowout well. Despite these advances, however, significant difficulties remain with respect to navigation of the relief wellbore. In particular, surveying error of only a fraction of a degree can result in significant deviations from the desired target at depths of two miles or more.

Numerous errors can seriously complicate efforts to kill a blowout well by drilling a relief well. In theory, the use of an off vertical relief well to intersect the blowout could be achieved accurately if the location of both the relief wellbore and the blowout wellbore could be known with sufficient accuracy. In practice however, the actual location of the blowout wellbore is rarely known with sufficient accuracy. Numerous errors are incorporated into the logging of the off vertical deviations during the drilling of the well. In general the types of errors which can be encountered with the location of the blowout wellbore are the following: 1) errors in the surface survey location; 2) random erros in the directional surveys; and 3) systematic errors in the directional surveys.

Various authors have previously recognized individual errors which might be encountered in determining the location of a wellbore. For example, in an article entitled "Borehole Position Uncertainty-Analysis of Measuring Methods and Derivation of Systematic Error Model," *Journal of Petroleum Engineering and Technology*, December 1981, pages 2339–50, Wolff and De Wardt, discuss systematic errors which are often incorporated into direction surveys of a wellbore. In addition, in another article, "Analysis of Uncertainty in Directional Drilling," *Journal of Applied Petroleum* April 1969, Walstrom, Brown and Harvey, discuss random errors which can significantly affect the accuracy of directional surveys of a wellbore. The errors described in the above mentioned articles apply to both the target blowout wellbore and to the relief wellbore. Although the above mentioned articles are useful to the extent they describe two types of errors which contribute to uncertainty as to the location of the respective wellbores, the art has heretofore lacked a teaching of a method for combining these uncertainties to provide a more effective surveying system for using relief wells to kill blowout wells. Furthermore, the prior art surveying techniques have failed to adequately incorporate errors related to the surface survey location. The infamous Ixtoc 1 is an example case where the error in the surface site location, later measured to be 224 feet, delayed the kill of the blowout by several months. The surface site error of the relief well is typically much smaller than that of the original blowout wellbore, principally due to greater care in documenting the location of the relief well.

In view of the foregoing discussion, it is evident that an accurate method for determining the relative locations of the original blowout wellbore and the relief wellbore is needed. More specifically, it is apparent that there is a need for a more effective surveying system which is capable of combining errors in the surface survey location with random errors and systematic errors related to directional surveys. The surveying system of the present invention, as described in greater detail below, provides a relative probable location distribution (RPLD) which includes an estimate of surface site errors and the systematic and random errors due to directional surveys of both the blowout and relief wells.

SUMMARY OF THE INVENTION

The present invention overcomes the difficulties of the prior art by providing an improved surveying system for drilling a relief well to intersect a target blowout well. One of the principal advances over the prior art provided by the present invention is the use of a probable location distribution for surveying the location of the candidate relief wells and the blowout well. Through the use of the relative probable location distribution, the integral probabilities of find, intercept and collision are calculated. A relief well plan is then optimally designed to be safe, easy and fast to drill and insure a high integral probability of a find and intercept and a low probability of a collision.

After the relief well is spudded, the drilling progress of the wellbore is continually monitored, directional surveys are processed, and the relative probable location distribution is continuously calculated. When the relief wellbore is in the preplanned position for the optimum first search, the first search is run. When the "find" is made, the relative probable location distribution is set equal to the error probabilities of the search, which is usually small, and the relief well path to the target position is planned.

The method provided by the present invention allows a relief well to be drilled in a minimum time with minimum risk exposure. As a result, the present invention makes it possible to avoid many of the catastrophic problems associated with blowout wells, in particular, loss of life, physical property loss, energy reserve loss and pollution of the environment. Furthermore, the present invention minimizes risks associated with unwanted or untimely collision of relief well with the blowout well, which could result in the relief becoming a blowout well also.

Detailed Description of the Preferred Embodiment

Figure 1:
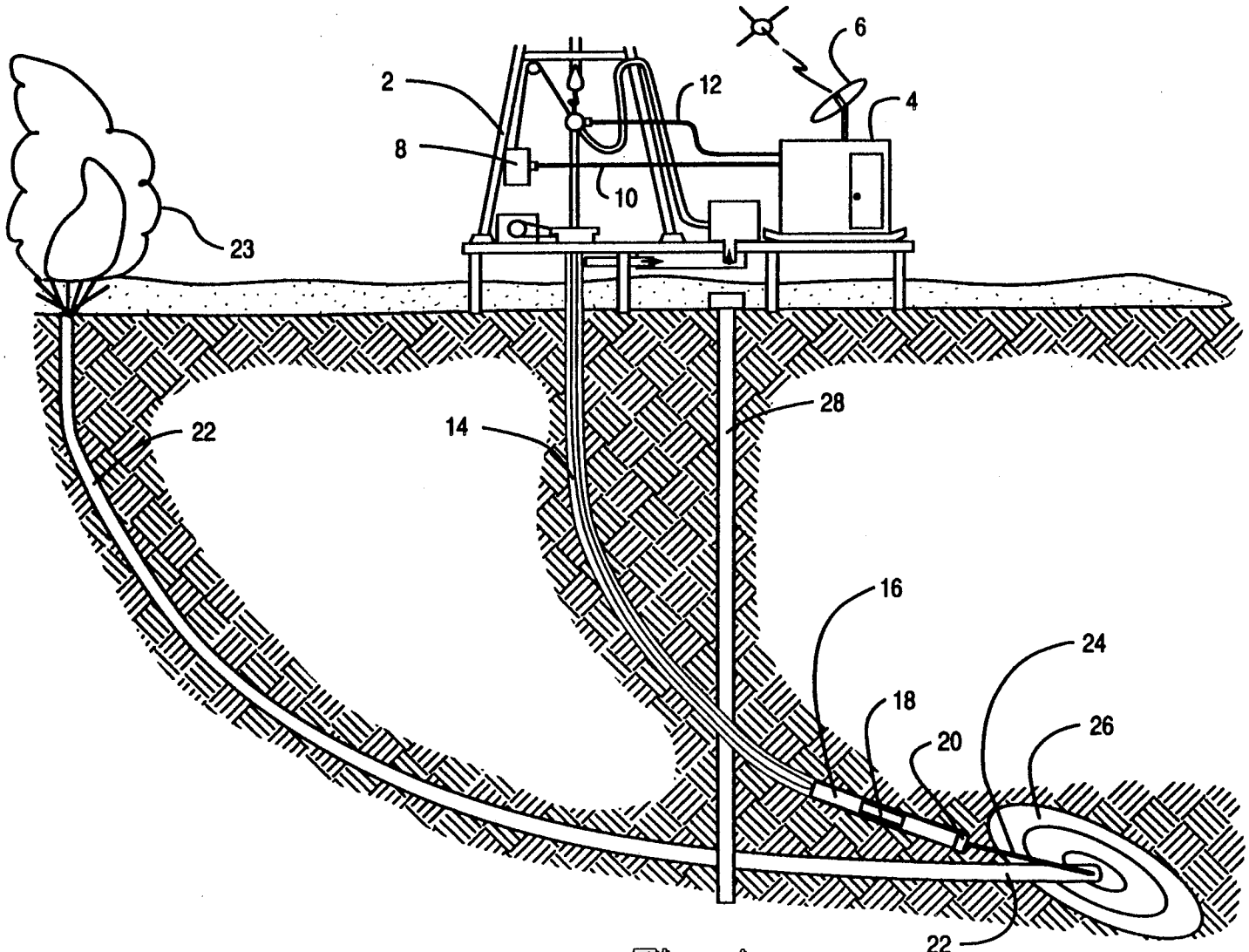
FIG. 1 is an illustration of an offshore rig drilling a relief well to intersect a blowout well.

A general view of an offshore relief well drilling operation to intersect and kill a blowout well utilizing the method and apparatus of this invention is illustrated in FIG. 1. The drill site is equipped with a conventional drilling rig, 2, a data acquisition and processing center, 4, communications facilities, 6, a measured depth sensor, 8, and communications links, 10 and 12. The data acquisition system in the data center, 4, receives measured depth data via link, 10, and downhole generated data via link, 12, from the upward communications system, 16, which is located near the bottom of the relief well, 14. Typically, the upward communications system is a commercial Measurement-While-Drilling, MWD, service. Directional survey sensors, 18, are included, along with other sensors, in the downhole system, 16. The drill bit, 20, used to drill the well, 14, may be powered directly by rotation of the drill string or by downhole motors, not shown. Commercial directional drilling assemblies used to control the direction of the well, 14, are not shown for simplicity. The blowout well, 22, is shown with a surface fire, 23, which obscures the surface location and prevents operations in the near vicinity. The relief well, 14, is directionally drilled along a planned profile, 24, which includes a search path, shown later, designed to optimize finding and intersecting the blowout well, 22. The relative probable location distribution (RPLD), 26, shown at a specific depth of the blowout well, 22, where the relief well, 14, is designed to intersect the blowout well is a major aspect of the invention. The relief well, 14, is planned and drilled to avoid a hazardous collision with the nearby well, 28. The details of the method and apparatus of this complex systems operation are described below.

SEARCH TOOLS

Figure 3:
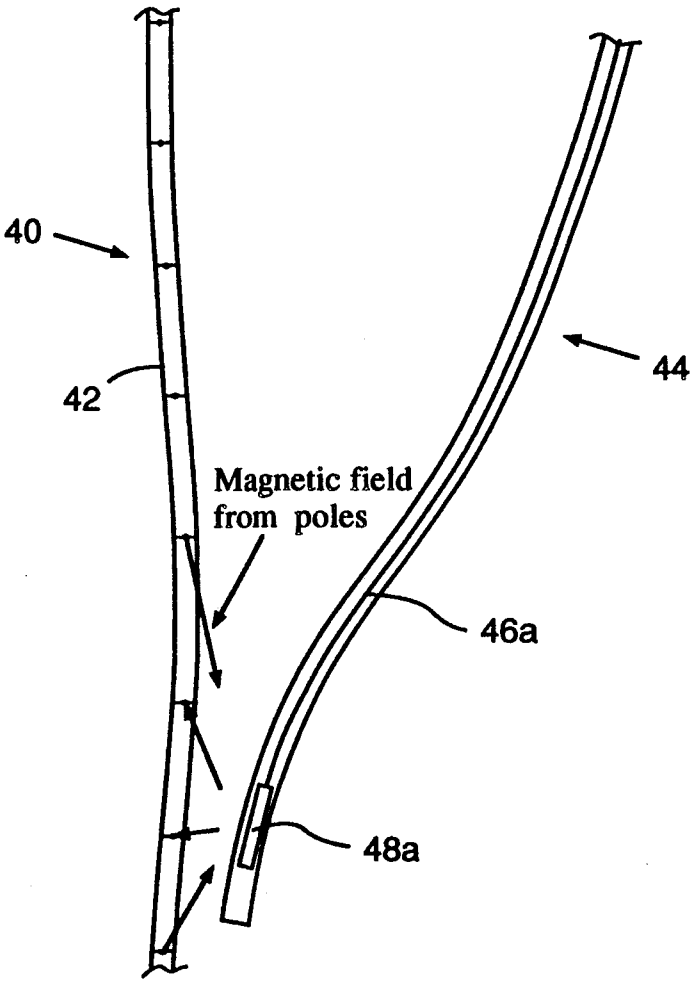
FIG. 3 is an illustration of a relief wellbore containing a static magnetism search tool for locating a blowout wellbore.
Figure 2:
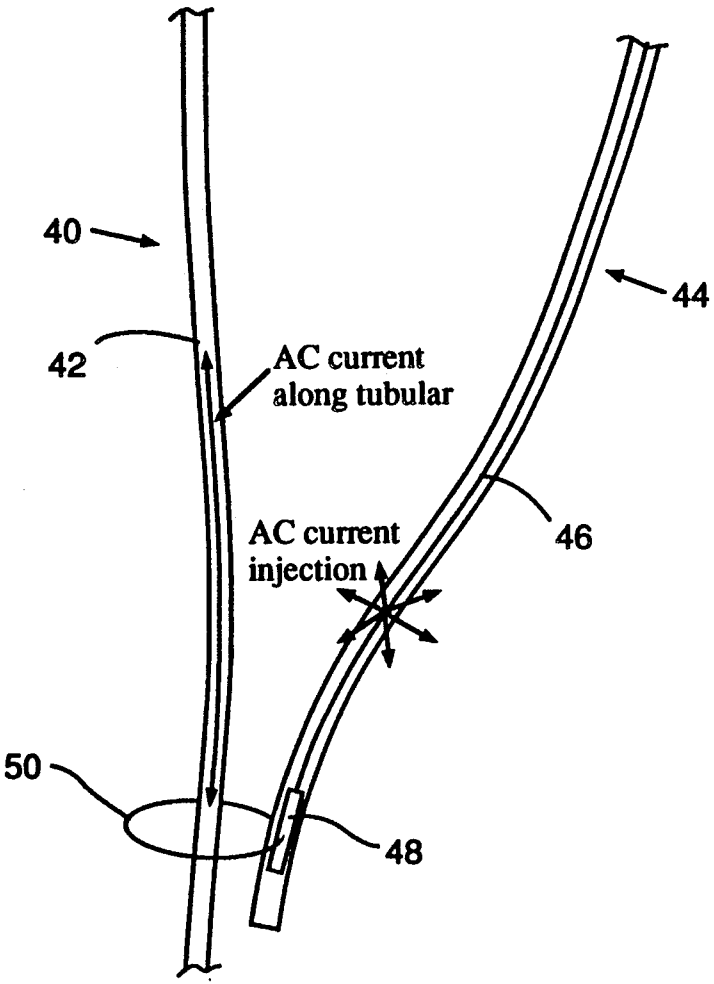
FIG. 2 is an illustration of a relief wellbore containing an induced magnetism search tool for locating a blowout wellbore.

The method and apparatus of the present invention is not limited to any particular type of searching tool. However, in order to better understand some of the concepts which will be discussed hereinbelow, reference is made to FIGS. 2 and 3 which show two common types of search tools. FIG. 2 is an illustration of an induced magnetism search tool used to search the area around the relief well for conductive tubulars in the blowout well. FIG. 3 is an illustration of a static magnetism search tool used to search the area around the relief well for magnetic poles licated in the magnetic tubuklar in the blowout well. Referring to FIG. 2, a blowout wellbore 40 is shown with the wellbore being defined by a conductive tubular 42. A relief wellbore 44 is shown having a wellbore path designed to intersect the blowout wellbore 40. A wireline search tool 46 is contained within the relief wellbore. The wireline search tool operates by producing AC current injection as shown in FIG. 2 to induce an AC current along the tubular collar 42 of blowout wellbore 40. Over the relatively short distances involved, the AC current in the tubulars may be considered to be flowing along a substantially stright line; consequently, the associated AC magnetic field has a cylindrical form where the blowout wellbore is the axis. The AC magnetic field sensors 48 located in the relief wellbore 44 measure the said cylindrical AC magnetic field 50 in the plane perpendicular to the axis of the blowout well. These magnetic field data are used to calculate the distance and direction in the said plane from the blowout wellbore to the relief wellbore. The orientation of the plane will be discussed in greater detail below in connection with the "compare view" plane.

Referring to FIG. 3, a blowout wellbore 40 is again shown with a relief wellbore 44 designed to intersect the blowout wellbore 40. The wireline search tool 46a used in the static magnetism search method comprises a plurality of static magnetic field vector sensors 48a. These static magnetic sensors measure the static magnetic field associated with the magnetic poles which generally exist at mechanical joints in the blowout wellbore tubulars. These magnetic field measurements are made at a plurality of depths in the relief wellbore. The resulting profile of the static magnetic field as a function of depth in the relief wellbore is used to calculate the distance and direction in a defined plane from the relief wellbore to the blowout wellbore.

Surveying systems such as those discussed above are shown generally in U.S. Pat. Nos. 4,072,200; 4,372,398; and 4,529,939, which by this reference are incorporated herein for all purposes.

SEARCH SCHEME

The principal requirement of an efficient search scheme is to continuously and efficiently search in previously unsearched areas of the relative probable location distribution, discussed in greater detail below, while keeping track of the previously searched areas and summing the probabilities of a find until the total grows to a very high percentage. The probability of detecting a blowout at any given location is the portion of the probability density covered by the search radius of the search tool. The total probability covered depends upon the radius of the search and probability density in the covered area of the relative probability location distribution. This is the probability of detection at this single depth. Ideally, the search path of a relief well is designed so that as the well progresses to successive depths, the area covered by the search tool is a different portion of the relative probability location distribution which has not previously been investigated. Consequently, as the search tool is pulled along the relief wellbore to different depths, new areas of the relative probability location distribution are covered by the search radius of the search tool. The new areas of probability are summed as the tool is pulled over different depths to give the integral probability of find to the depth logged. By properly designing the search path of a relief well, this integral probability of find can be made as large as desired, approaching one hundred percent.

One of the principal difficulties in perceiving the search path concept described above is related to an understanding of how new areas of the relative probability location distribution are known to be searched. When directional surveys are available for both the blowout well and the relief well, the change in the expected relative position for the two wells is described by the change in the calculated well profiles with depth and the error in this change is represented by increases in the relative probability location distribution. The growth of the relative probable location distribution is generally less than proportionate with the percentage change in well profile position. Consequently, the error in the change may be considered negligible over reasonable distances along a search path, which is short relative to the entire relief well depth.

For cases where there are no directional surveys for the blowout well, it is generally sufficient to assume that the blowout wellbore is straight ahead over the distance of a search path. This assumption is generally valid since directional surveys are required on all intentionally off vertical wellbores.

PROBABLE LOCATION DISTRIBUTION (PLD)

The probable location distribution (PLD) is a quantitative description of where the wellbore is located in statistical terms. Prior art discussions of uncertainty of the location of a wellbore sometimes refer to "an ellipse of uncertainty." However, the ellipse of uncertainty should not be confused with the probable location distribution, nor the relative probable location distribution discussed below. The term probable location distribution, as is used here, is intended to provide a more complete, accurate, and positive term and should be distinguished from the prior art standards.

Wellbore location profiles are determined by measuring the direction, both the inclination and azimuth, of the wellbore from top to bottom at intervals of depth, typically between thirty and one hundred feet. The well profile is then computed from these directional data using one of several algorithms known in the art, including average angle, tangential, balanced tangential, radius of curvature and minimum curvature. The minimum curvature algorithm is preferred for use in the system of the present invention.

As is the case with all physical measurements, the directional measurements discussed above contain errors. Walstrom, et al, discussed above in the background section, recognized random type errors and provided an analysis called the ellipse of uncertainty. The ellipse grows as the well gets deeper, but grows slowly after a large number of measurements, due to the random nature of the error.

Wolff et al recognized a much more important form of error, called systematic error. The major difference between systematic and random error is that systematic errors generally accumulate proportionate with distance, leading to much larger ellipses in deep, deviated wells. The Wolff et al analysis includes systematic errors of the various wellbore survey instruments and sums these errors over the depth of the well. Although Wolff et al provided an analysis of systematic errors, their analysis did not recognize the use of random errors as discussed above. Furthermore, the Wolff et al analysis did not utilize the quantitative distribution nature of the ellipse, but, rather, preferred to treat the ellipse as if it were a boxcar distribution or fence containing all of the error of where the well might be. In addition to the failure to combine random and systematic errors, no previous system for analyzing position error has taken into account errors in the surface site location. The surveying system of the present invention is capable of providing a composite probability location distribution based on random errors, systematic errors, and all other known location errors, most notably, the survey error in the surface site location and drill ship positioning error, when applicable.

In addition to random and systematic properties of errors recognized by Walstrom et al and Wolff et al; respectively, errors may have an expected value (or mean value) that is non-zero. Magnetic compass error caused by drill collar magnetization is an example of error which has a predictable expected value. When the expected value of error, such as due to collar magnetization, is removed and a well location profile is calculated, the locations become expected locations as opposed to the state-of-the-art or normal locations. An expected location is at the center of the PLD or RPLD where the probability density is highest.

In the surveying system of the present invention, a programmable processor is used to accumulate variances of each of the above discussed errors. The inputs to the accumulator include: 1) random error accumulation over any section of directional survey; 2) systematic error accumulation over any section of directional survey; 3) any known error such as surface site survey and drill positioning error can be manually input either as a covariance array or as principal axes of the ellipsoid. Additionally the processor is used to remove or correct for the expected error, as desired.

When all or any desired portion of the above discussed errors have been input to the system, the probable location distribution accumulator contains a covariance array which represents the probable location distribution to the depth entered. The processor can be used to provide an output of the probable location distribution in surface coordinates or in any downhole coordinate system desired. For example, it can be used to provide an output of the probable location distribution as an ellipse in a plane perpendicular to the axis of either the blowout well or the relief well. Normally, in the preferred embodiment, error coefficients are input as standard deviation (one sigma) values to the probable location distribution. In the system of the present invention, a "compare" program can be used to produce a plane perpendicular to the axis of a chosen reference well, and any number of ellipses can be entered representing multiples of the PLD sigmas. These ellipses then represent the probable location distribution of the reference well about its axis.

RELATIVE PROBABLE LOCATION DISTRIBUTION (RPLD)

The surveying system of the present invention utilizes a relative probable location distribution (RPLD) which is an extremely powerful aid in the quantification of the relative location of the relief wellbore to the blowout wellbore. This relative probable location distribution represents a significant advance in the art, since it incorporates all of the errors discussed above and provides a composite estimate of the error of estimating each of the wellbores relative to each other.

MATHEMATICAL DESCRIPTION OF THE RELATIVE PROBABLE LOCATION DISTRIBUTION

For the location p (which may be in the relief well) and the point q (which may be in the blowout well) there is a probability density function $\Phi_{p,q}(x,y,z)$ that describes the location of q with respect to p. The meaning of this function is that the probability that the point q will be found in any particular volume V is the integral of $\Phi_{p,q}$ over that volume; i.e., $$\text{Probability } (q \text{ in } V) = \int\int\int_V \Phi_{p,q}(x,y,z)dx\,dy\,dz$$

The density function $\Phi_{p,q}$ is a result of the limits of accuracy in the measuring process. It is determined by the errors associated with an individual measurement and errors that are in common with a group of measurements.

Several processes of interest, such as collision, search-tool find, etc., are proximity dependent and occur with respect to any of a number of points {q} in the blowout well or from any number of points {p} in the relief well, or both. In cases of interest, the distribution does not vary appreciably over the set of points and can be approximated by integrating the distribution along a straight line. The result is a two dimensional distribution $\Phi_d(h,r)$ in a plane perpendicular to the line of integration:

$$\Phi_d(h,r) = \int_{-\infty}^{\infty} \Phi_{p,q}(x,y,z)da$$

Where a, h and r represent the coordinate directions in the ahead, high, and right coordinate system. In this case, the probability that the well crosses the plane within some area A, which has been defined by the process of interest, is the integral, $$\text{Probability (well-crossing in } A) = \int\int_A \Phi_d(h,r)dh\,dr$$

IMPLEMENTATION VIA NORMAL DISTRIBUTIONS

Figure 4:
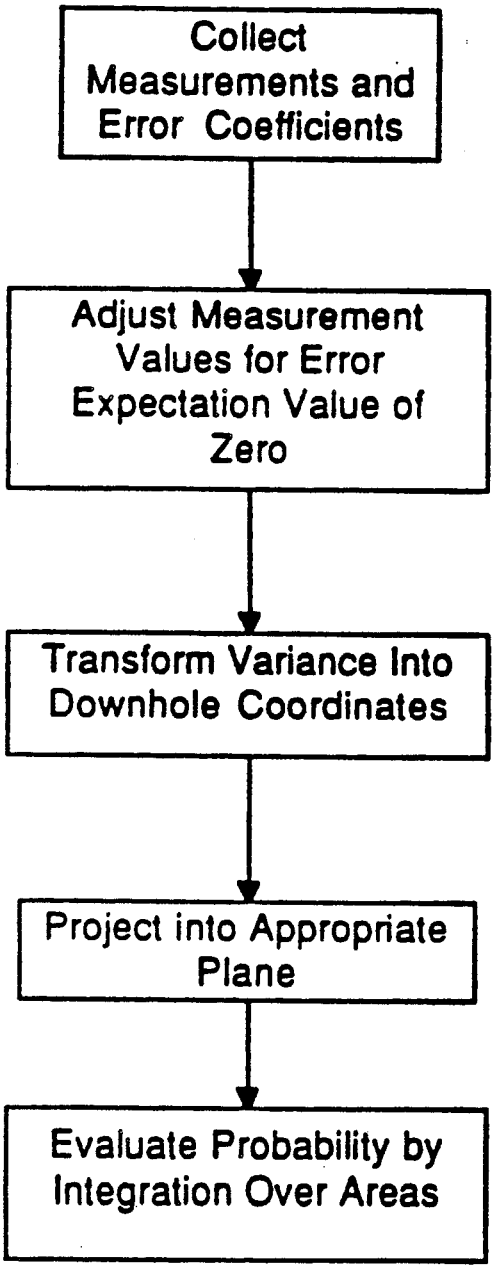
FIG. 4 is a process flowchart describing the process for obtaining the relative probable location distribution of the present invention.
Figure 6:
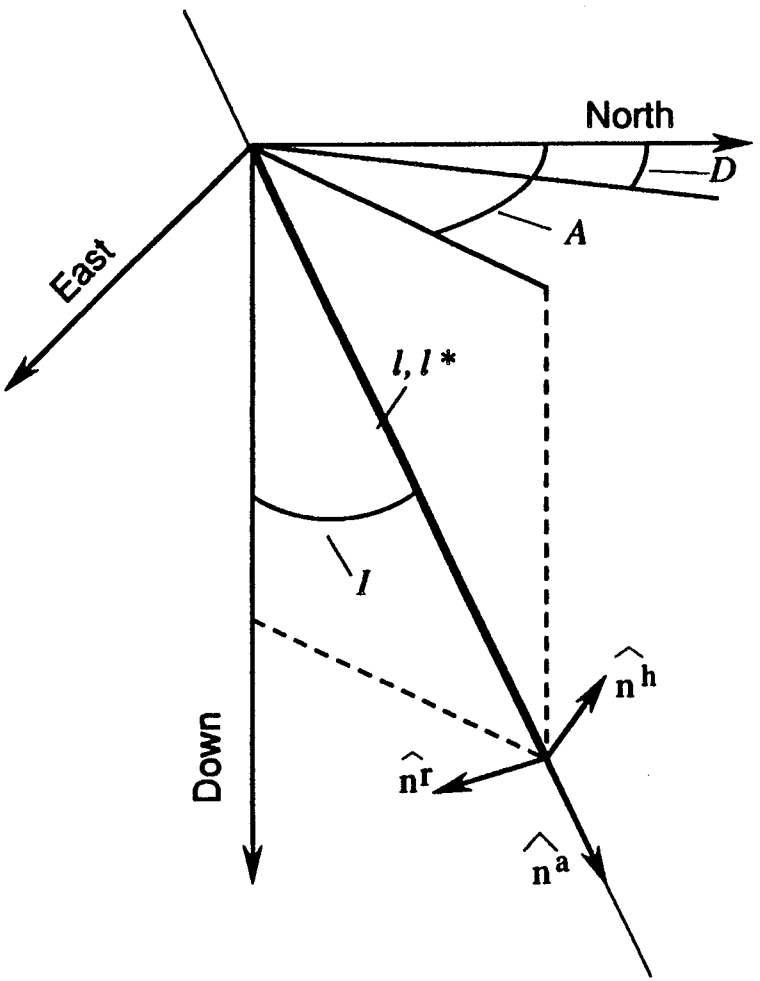
FIG. 6 is a geometric description of the relationship of the terms used in the calculation of the relative probable location distribution of the present invention.

One means of evaluating the probability density function and related area-integrals is to use normal (Gaussian) distributions. FIG. 4 is a block diagram of the full process. All of the measurements are analyzed and the errors are separated into errors or groups of errors that are independent (mathematically random) with respect to each other. Every error or group applies to an interval (distance) and may refer to a single measurement or a series of measurements.

Figure 5:
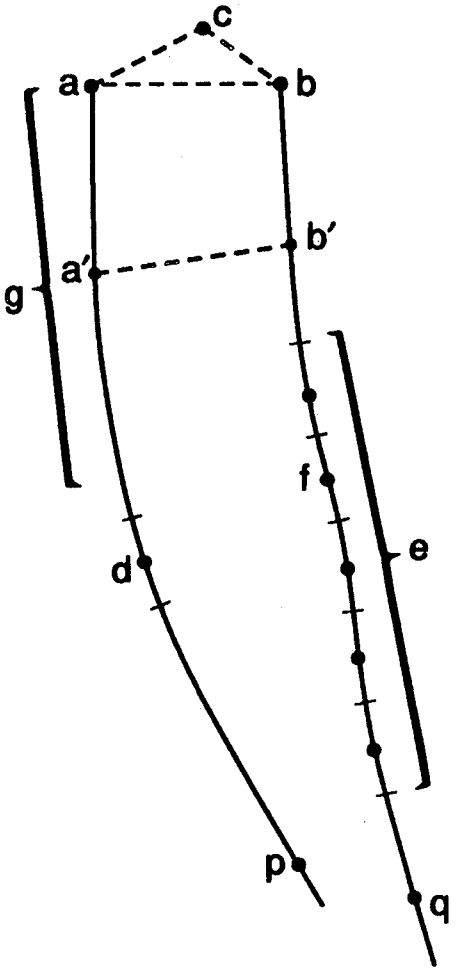
FIG. 5 is a geometrical illustration of the process of determining the relative probable location distribution of the present invention.

As shown in FIG. 5, for the general case where p is in one well and q is in another, there are two distinct types of measurements. The first type are those measurements that locate some point in the second well (generally other than q) with respect to some point (generally other than p) in the first. Examples of this include:

- Independent determinations of the locations of the two well heads (a and b located from some common point c)
- The direct determination of the location of one wellhead from the other (a from b or vice versa)
- The subterraneous measurement of the location of some point in one well from some point in the other (a' from b' or vice versa)

In each case, the size, shape, and orientation of the probability distribution is determined by the geometry and the measurement principles.

The second type of measurement is a survey along a wellbore. There are many different kinds of directional survey tools in use, such as those discussed hereinabove. In many of these systems, the measurement produces values for distance along the wellbore (called the measured depth), the inclination with respect to vertical, and the azimuth angle referenced to north. In FIG. 5, d is a directional measurement which has an error or errors associated only with that one measurement and is not affected by errors in any other measurement. The group of directional measurements e have an error or errors common to all of them; the magnitude of the error is not necessarily the same for each but there is a functional relationship between the values for the errors. The directional measurement f has additional errors not related to the other measurements in the group.

Other borehole survey methods have different properties. One example of such is the inertial reference tool that directly measures three orthogonal displacements over an interval such as g. It produces an error distribution that combines an azimuth reference error and a three dimensional distribution that is a function of the path geometry, the temperature, the speed of the survey run, and various other factors.

For some types of directional survey errors, the covariance matrix V can be expressed in terms of the vector errors. Examples of suitable errors are listed in (but not restricted to) Table 1. For the $i^{th}$ error parameter, $V_i = \overleftrightarrow{e_i}\overleftrightarrow{e_i}$ where $\overleftarrow{e_i}$ is the vector error produced by one standard deviation of the measurement error. The vector error itself is the sum of the vector errors over each measurement interval;

$$\overleftarrow{e_i} = \sum_j \overleftarrow{e_{i,j}}$$

where $e_{i,j}$ is the error of the $i^{th}$ error parameter in the $j^{th}$ measurement interval over which it applies. (For some errors, there is only one measurement interval.)

$$\overleftarrow{e_{i,j}} = \begin{pmatrix}\text{weighing function}\\ \text{evaluated for the}\\ j\text{th interval}\end{pmatrix} \cdot \sigma_i \cdot \begin{pmatrix}\text{geometrical influence}\\ \text{factor evaluated}\\ \text{for } j\text{th interval}\end{pmatrix} \cdot \begin{pmatrix}\text{unit vector in the direction}\\ \text{required by the } i\text{th error,}\\ \text{evaluated for the } j\text{th interval}\end{pmatrix}$$

The specifics for each of these terms is explained for the types of errors covered in Table 1.

TABLE 1

| Description of Error | Weighting Function | Specification of Standard Deviation | Geometrical Influence | Direction of Error |
|---|---|---|---|---|
| azimuth reference error | 1 | angle | $l_j^* \sin I_j$ | $\hat{n}_j^r$ |
| azimuth error due to magnetic remnants | $\sin I_j$ $\sin(A_j - D)$ | angle for horizontal and east | $l_j^* \sin I_j$ | $\hat{n}_j^r$ |
| gyro error | $\frac{1}{\cos I_j}$ | angle for vertical | $l_j^* \sin I_j$ | $\hat{n}_j^r$ |
| inclinometer bias error | 1 | angle | $l_j^*$ | $\hat{n}_j^h$ |
| true inclination error | $\sin I_j$ | angle for horizontal | $l_j^*$ | $\hat{n}_j^h$ |
| relative depth error | 1 | length per unit length | $l_j$ | $\hat{n}_j^a$ |

Nomenclature (Also see FIG. 5)

- I inclination—angle measured with respect to vertical
- A azimuth—bearing measured with respect to true north
- D declination—azimuth of the magnetic field
- l course length over which this measurement applies
- $l^*$ equivalent straight line length over which measurement applies
- $\hat{n}^h$ unit vector "high", perpendicular to the direction of the survey and in the vertical plane (or north plane if inclination is zero)
- $\hat{n}^a$ unit vector "ahead", in the direction of the survey
- $\hat{n}^r$ unit vector "right" or "lateral"; $\hat{n}^r = \hat{n}^a \times \hat{n}^h$ If the error parameter under evaluation is misalignment, the variance can be written:

$$V_i = \sigma_i^2 (l_i^2 I - \overleftrightarrow{r_i r_i})$$

where $\sigma_i$ is the standard deviation of the misalignment angle, I is the identity matrix, $$l_i = \sum_j l_j \quad \text{(the total course length), and}$$

$$\overleftarrow{r_i} = \sum_j l_j \hat{n}_j^a \quad \text{(the total displacement vector).}$$

If $V_i$ is the set of variances in the location of q due to the set of independent error parameters, then the total variance in q is the sum; i.e., $$V = \sum_i V_i$$

and thence, $$\Phi_{p,q}(x,y,z) = N e^{-\frac{\overleftarrow{r} \cdot V^{-1} \cdot \overleftarrow{r}}{2}}$$

where N is the normalization constant and $\vec{r}$ is the location vector $(x\hat{i} + y\hat{j} + z\hat{k})$.

For appropriate values of inclination and azimuth, let T be the transformation that converts from surface coordinate directions (north, east, & down) to the downhole set (high, right, & ahead). Then $$\Phi_{p,q}(x',y',z') = N e^{-\frac{\overleftarrow{r'} \cdot V' \cdot \overleftarrow{r'}}{2}}$$

where $\hat{r}' = T.\vec{r}$ where $\overleftarrow{r'} = (x'\hat{n}^h + y'\hat{n}^r + z'\hat{n}^a)$ and $$V' = TVT^{-1}$$

The integral over one axis is the same as the projection of the distribution into the perpendicular plane. For example, integration along the "ahead" axis is the projection into the "high-right" plane. This projection is easily done by considering only the high-right submatrix.

$$\Phi_a(h,r) = N e^{-\frac{[hr] \cdot \begin{bmatrix} V'_{1,1} & V'_{1,2} \\ V'_{2,1} & V'_{2,2} \end{bmatrix}^{-1} \cdot \begin{bmatrix} h \\ r \end{bmatrix}}{2}}$$

The normal geometric factors (standard deviations and tilt angle) are calculated by rotating the high-right axes and comparing with the expression for the simple two-dimensional normal density function $$\Phi(x,y) = \frac{1}{2\pi\sigma_x\sigma_y} e^{-\frac{\left[\left(\frac{x}{\sigma x}\right)^2 + \left(\frac{y}{\sigma y}\right)^2\right]}{2}}$$

Figure 7:
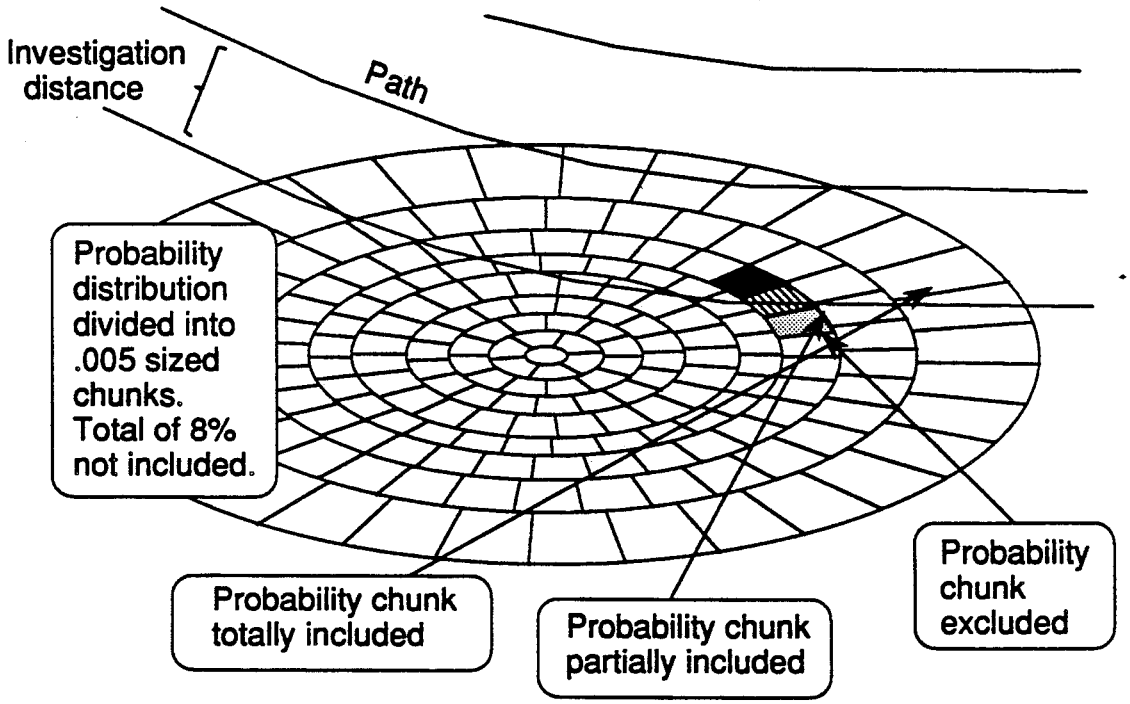
FIG. 7 is an illustration of a sector method for calculating the integral probability of find for the method of the present invention.

Probability of the well crossing the plane within an area A can be evaluated by any of a number of numerical techniques. One method, illustrated in FIG. 7, that is appropriate when the characteristic dimensions of the area are of the order of or larger than the standard deviations of the distribution, is to divide the distribution into small, equal-probability areas such that each one has a nearly square aspect ratio in normalized probability space coordinates ($X/\sigma_x$ etc.) Each probability area is examined for inclusion or exclusion with respect to the desired area and the probability totaled accordingly. In addition, some fraction may be included in the total for those that straddle the border of the area of integration.

Figure 8:
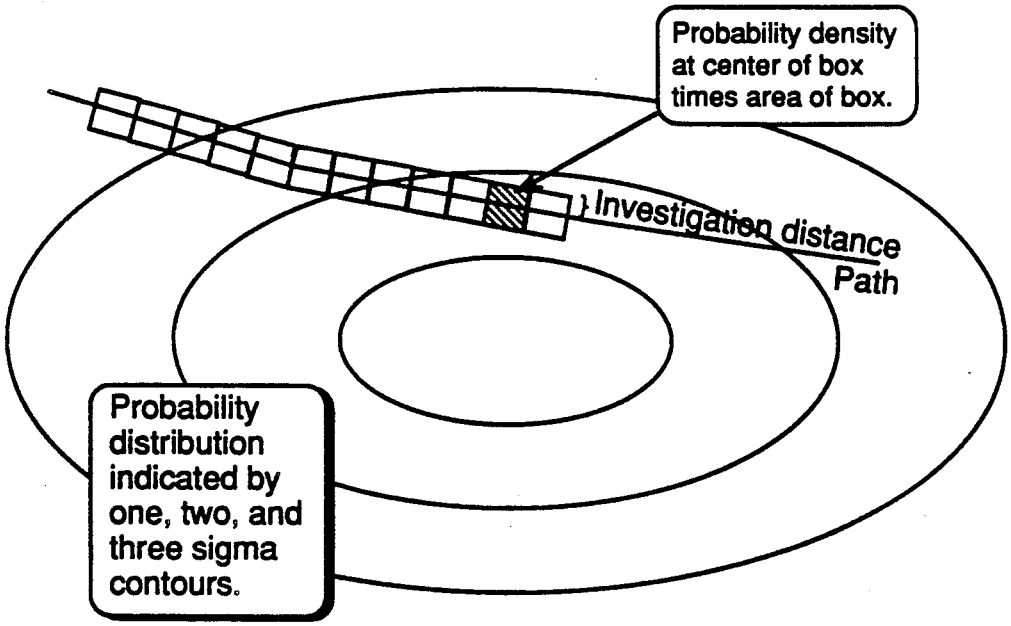
FIG. 8 is an illustration of a path method for calculating the integral probability of find for the method of the present invention.

Another method, illustrated in FIG. 8, is appropriate when the area can be described as a non self-crossing path with width small with respect to the standard deviations of the probability distribution. In this case, the area is broken into squares that are as long in path length as the specified width of the path. For each, the probability density is evaluated in the center of the square, multiplied by the area of the square, and totaled. Treatment of the end points and non integer-multiple path lengths are refined as desired.

OTHER METHODS OF IMPLEMENTATION

If desired, the probability density function and any desired processes that depend on proximity or geometry can be evaluated by random simulation techniques (Monte Carlo). The measurements are analyzed as before but in this case the errors may be functionally related to any extent that can be mathematically described. The path from downhole locations to the other locations satisfactory to the process of interest is calculated using randomly determined values of the errors. After a suitable number of path calculations, the probability is determined from the ratio of successful trials to the total number of trials.

The PLD (or RPLD) analysis discussed above is first used to calculate the probable location distribution of the blowout well and the relief well. The RPLD covariance matrix is the sum of the covariance matrices of the blowout well and relief well. For example, if all of the errors for both the blowout and relief wells are input to the PLD accumulator, then the accumulator contains the RPLD covariance matrix. The RPLD can be represented in any desired coordinate system. In the case that the relative surface site error of the two wells is known, as would be the case when the displacement between the two surface sites is directly measured, then the input to the PLD accumulator should be this relative surface site error (presumed to be smaller) rather than the two independent surface site errors of the blowout and relief wells.

The "ellipse of uncertainty," the closest industry concept, should not be confused with the RPLD. The RPLD is a tri-axial location error distribution which includes the surface site errors and the systematic and random errors due to directional surveys of both the blowout and relief wells. In the preferred embodiment, there are many components of location error, including the random, systematic and surface site errors previously discussed, which are treated as incoherent with each other; that is, they are random or non-correlated with each other. In this case, the component error variances are summed to obtain the total variance of the PLD or RPLD which may be represented by ellipsoids of constant probability density. These ellipsoids may be integrated along a direction perpendicular to a plane of choice to produce two-dimensional ellipses in that plane.

SEARCH PATH

One of the important parameters is the range of the available search tool in terms of an effective radius. The tubular specifications of the blowout well casing, the resistivity of the formation, and the properties of the mud used in the relief well are also gathered as important evaluation criteria. In addition, the search range of both the induction and static magnetic tool must be evaluated.

It is extremely important to plan the relief well in a manner such that its probable location distribution makes only a small contribution to the relative probability location distribution. Once the wellpath has been planned, the relative probability location is calculated using anticipated relief well survey error coefficients. As the relief well progresses along a search path, the probabilities of "find" and "intercept" are calculated. The essential inputs for calculating these probabilities are the search radius of the search tool, the relief well plan (including the search path), the limiting well curvature, and the relative probable location distribution. The probability of collision can also be calculated by assuming an effective collision radius, normally on the order of one foot. The above discussed process is an iterative process. The search path design (a portion of the relief well plan) is iterated until the probabilities of find and intercept are very high, the probability of collision is very low, and the overall relief well plan can be implemented easily and safely. When the search plan adequacy criteria are met, the search plan is adopted as the final relief well plan.

The optimal first search point is preplanned to have as high a probability of find, POF, as is compatible with a sufficiently low probability of collision, POC. It is also very important to retain a very good position from which to plan the closure maneuvers to kill the target blowout well. Although variable, the typical first search POF is on the order of 65% and the POC is normally less than 1%. The quantitative aspects of this procedure, as outlined above, are very important in achieving a minimum time to kill, because they are effective in eliminating unnecessary search runs. Indeed, the process outlined above, significantly increases the efficiency of the search even in cases where there is little difficulty locating the location of the blowout well. In the case of an extended reach (long horizontal distance) wells, two or three additional optimal search positions often must be planned in the event a find is not made on the earlier searches. The proper choosing of the search points to optimize POF, POC, and the ratio POF/POC is a major factor in relief well operations.

COMPARE VIEW

Figure 11:
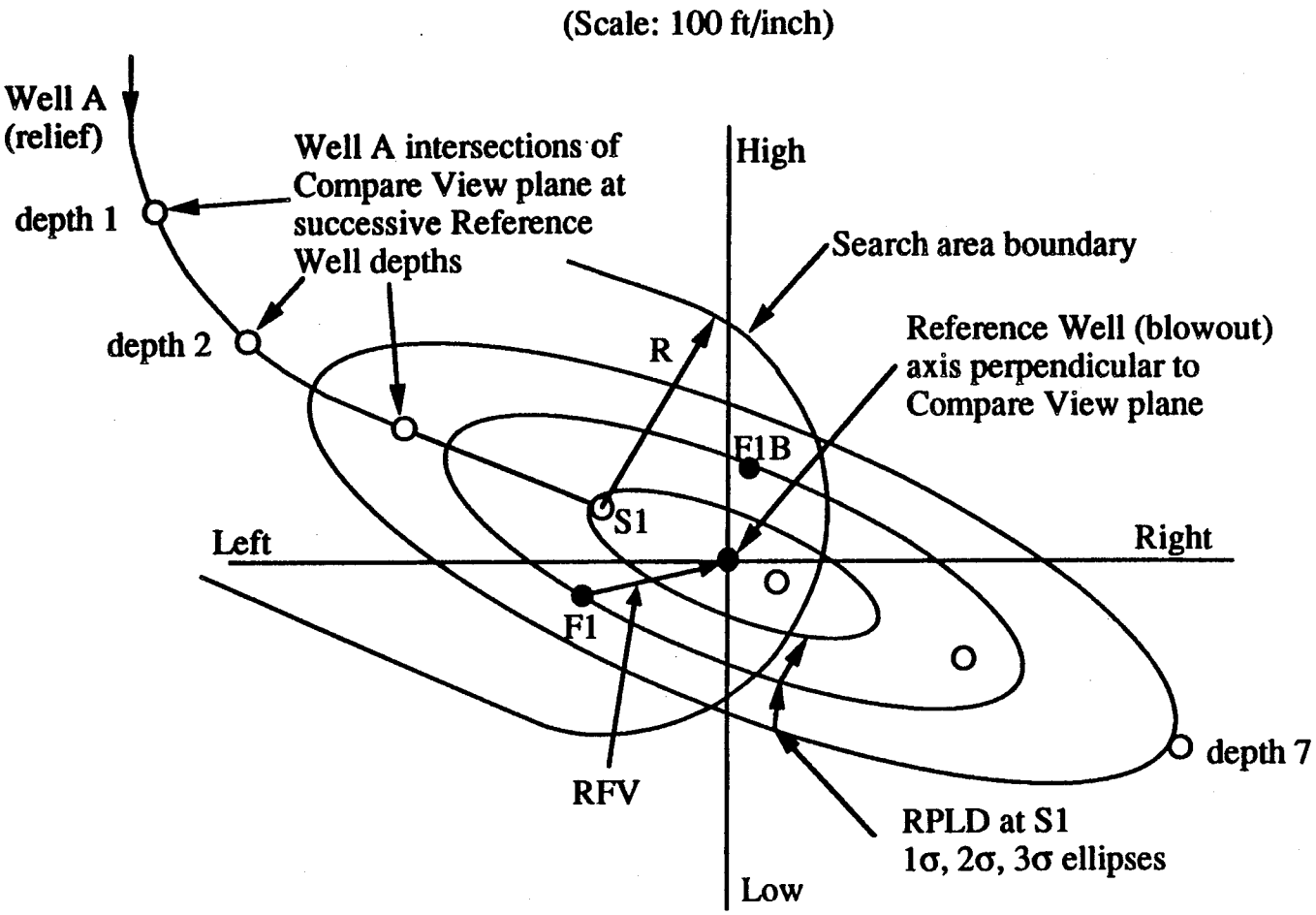
FIG. 11 is an illustration of the compare view used in the method of the present invention.

In order to understand the essential features of the present invention, one must understand the concept of a "compare view" of the relative location of the blowout well and the relief well. The Compare View is a plane perpendicular to a chosen reference well with the reference well located in the center at the crossing of the "high" and "right" axes. The high axis is defined as the intersection of the compare view plane with a vertical plane which is parallel and coincident with the along-the-hole axis of the reference well at the depth of the compare view plane. The right axis of the compare view is perpendicular to the high axis and the along-the-hole axis of the reference well. FIG. 11 is an example of the compare view where the line marked High-Low is the high axis and the line marked Right-Left is the right axis. The reference well is always at the high-right crossing in the compare view and defines the compare view. The compare view is specified by the direction of and depth in the reference well. In the special case where the reference well is near vertical at the depth of the compare view, the orientation of the compare view is normally determined by the geographic azimuth (from north) wherein High axis is replaced by North and the Right axis is replaced by East. Alternately, the magnetic azimuth may replace the geographic azimuth.

The blowout well is often chosen as the reference well. In this case, the compare view is specified by the depth, usually the measured depth, in the blowout well and the inclination and azimuth of the blowout well at said depth. The relative position of other wells which cross the compare view plane may be shown. The vector position of crossing of the compare view plane by other wells may be specified either as components along the compare view axes or as a distance from the center and azimuth from the high or north axis. The high and right components are often used.

Two versions of the compare view can be used. The definition just described above is for a single compare view plane wherein the reference is located at the center and other wells are shown where they cross the compare view plane at the specified depth in the reference well. Multiple compare views at successive chosen depths may be plotted. These multiple plots may be successively drawn on a plotter or animated on a computer screen. Furthermore, a computer can be programmed to superimpose the positions of the well crossings of the compare view at multiple successive depths in the reference well. The reference well remains at the center for all of the depths. A single plot of the compare view with superimposed positions of the wells may be made wherein the position of each well crossing is labeled for the depth of the reference well for the crossing.

The compare view was created for and is especially suited for computing and viewing the *relative* position and relationship of multiple wells; most notably a blowout well and one or more relief wells. This is particularly true when the wells are substantially parallel as is generally true during searching, closure and intersecting maneuvers on a blowout killing operation.

EXPECTED LOCATION AND RPLD DETAILS

Figure 15A:
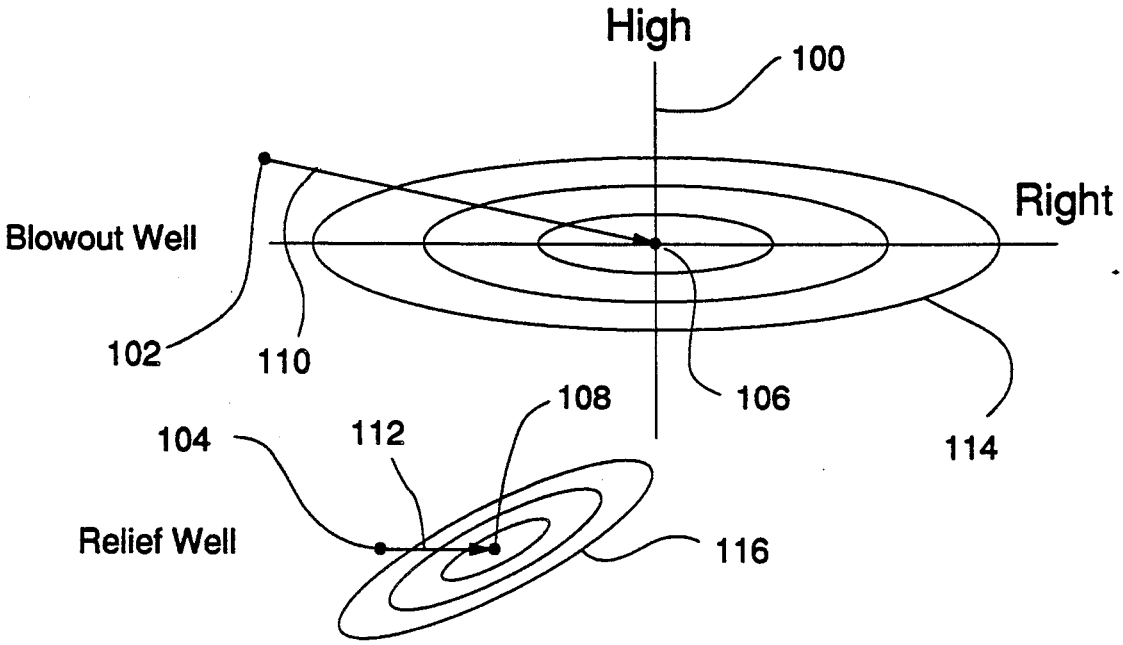
FIGS. 15*a–b* are illustrations of the probable location distributions and the relative probable location distribution of a blowout and a relief well.

FIG. 15*a* illustrates in the Compare View coordinate system, 100, a blowout well normal location, 102, expected error, 110, expected location, 106, and PLD, 114. Similarly, the normal location, 104, expected error, 112, expected location, 108, and PLD, 116, are shown for a relief well. The expected location, 106, of the blowout well is used as the center or reference of the Compare View coordinates such that all other locations are relative to the blowout well expected location. The expected locations, 106 and 108, are centered at the highest probability density of the PLDs, 114 and 116, respectively. The PLDs, 114 and 116, are the two-dimensional 1, 2, and 3 sigma ellipsoidal representation of the probability density function for the blowout and relief well locations, respectively.

Figure 15B:
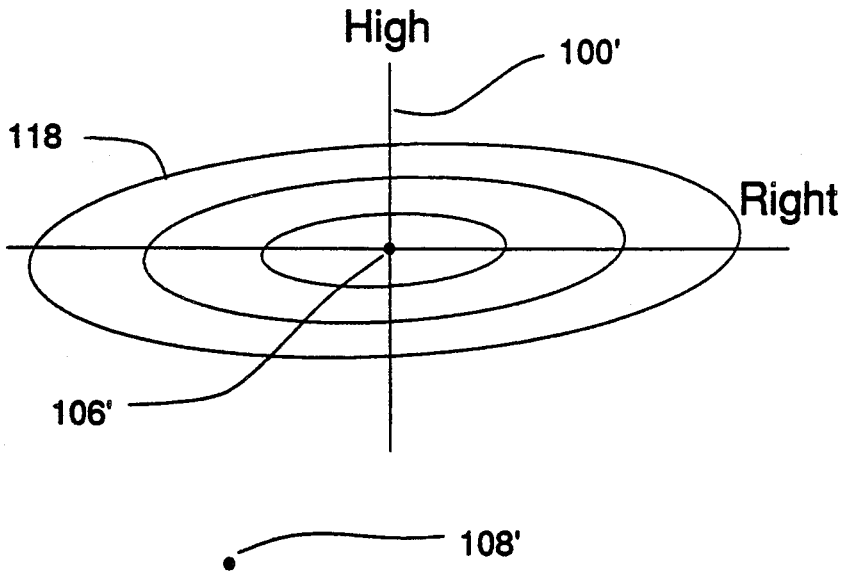

FIG. 15*b* illustrates a major simplification wherein the PLDs, 114 and 116, of FIG. 15*a* are mathematically combined to create the RPLD, 118, cast in the Compare View, 100'. The RPLD, 118, is centered around the blowout well expected location 106'. The relief well expected location, 108', is shown in the same relative position as in FIG. 15*a*. The RPLD, 118, represents the total relative probable location distribution density function for both the blowout and relief wells. It should be noted that the RPLD is larger than and oriented differently than either the blowout or relief PLD.

OPTIMUM RPLD AND SEARCH PATH

Figure 16A:
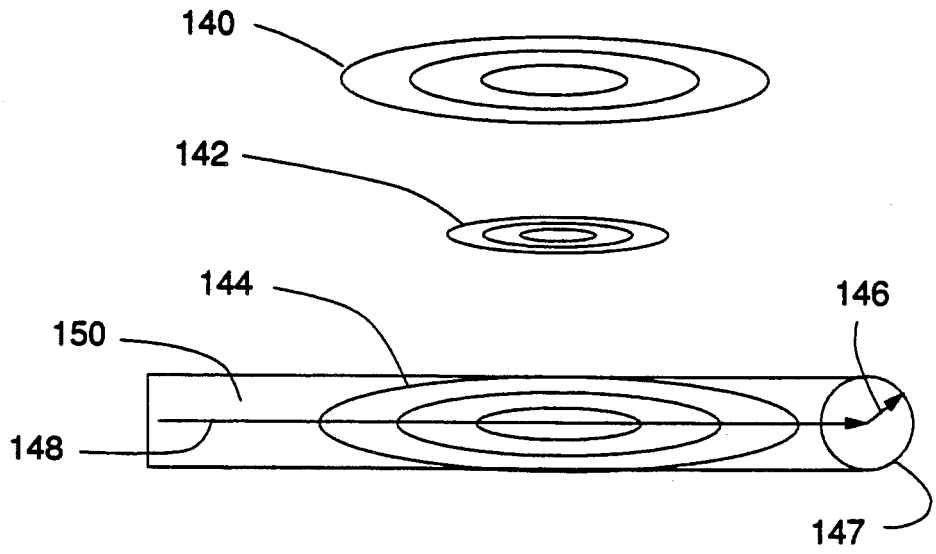
FIGS. 16*a–b* illustrate the effect of individual well probable location distributions on the relative probable location distribution.
Figure 16B:
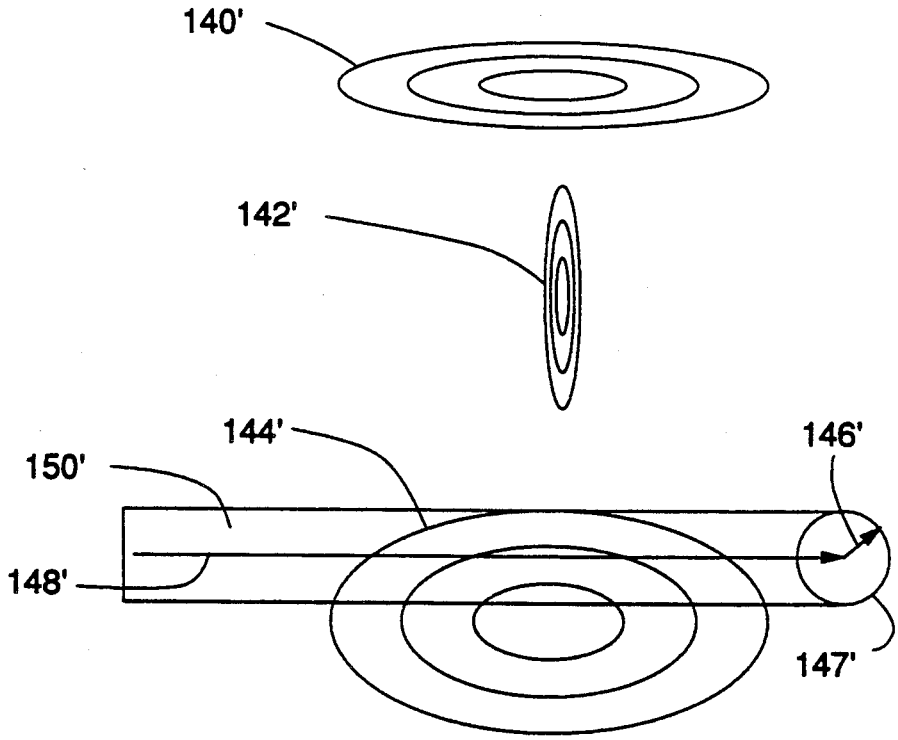

FIG. 16*a–b* illustrates the effect and significance of controlling the relief well path on the RPLD and Probability of Find, POF. FIG. 16*a* shows the blowout well PLD, 140, the relief well PLD, 142, and the RPLD, 144, for an optimally elected relief well path. The relief well PLD, 142, is one half the size of the blowout well PLD, 140, and has the same orientation. Consequently, the RPLD, 144, is 12% larger than the blowout well PLD, 140, and is oriented the same. Also shown in FIG. 16*a* is the relief well search path, 148, the search radius, 146, of the search tool, the area searched, 150, along the search path, 148, and the the circular area searched, 147, at the end of the search path, 148. For this operation, the POF is 99%.

FIG. 16*b* is a similar illustration with the same blowout well PLD, 140', the same size but 90° oriented relief well PLD, 142', and a strikingly different RPLD, 144'. Also shown in FIG. 16*b* is the relief well search path, 148', the search radius, 146', of the search tool, the area searched, 150', along the search path, 148', and the the circular area searched, 147', at the end of the search path, 148'. The search radius, 146', is the same as the search radius, 146, in FIG. 16*a*. For this operation, the POF is approximately 45%. This dramatic drop in POF is due to two factors: 1. The increased size of the RPLD, 144', over the RPLD, 144, and 2. the relief well search path, 148', being off center of the RPLD, 144'.

Further, not illustrated, the orientation of the search path with respect to the RPLD is important in optimizing the POF. The search path orientation shown in FIG. 16*a–b* is optimum and any other orientation would produce a lower POF. An orientation change of 90° would result in a much reduced POF.

With this background reconsider the search scheme discussed earlier wherein the search proceeds in previously unsearched areas while keeping track of the area searched and summing the probability of find, POF, until the total grows to a high probability. Examination of FIG. 16*a–b* shows the desirability of searching in the high probability density areas on a priorty basis.

A PERSPECTIVE VIEW OF THE RPLD COMPONENTS

Figure 17A:
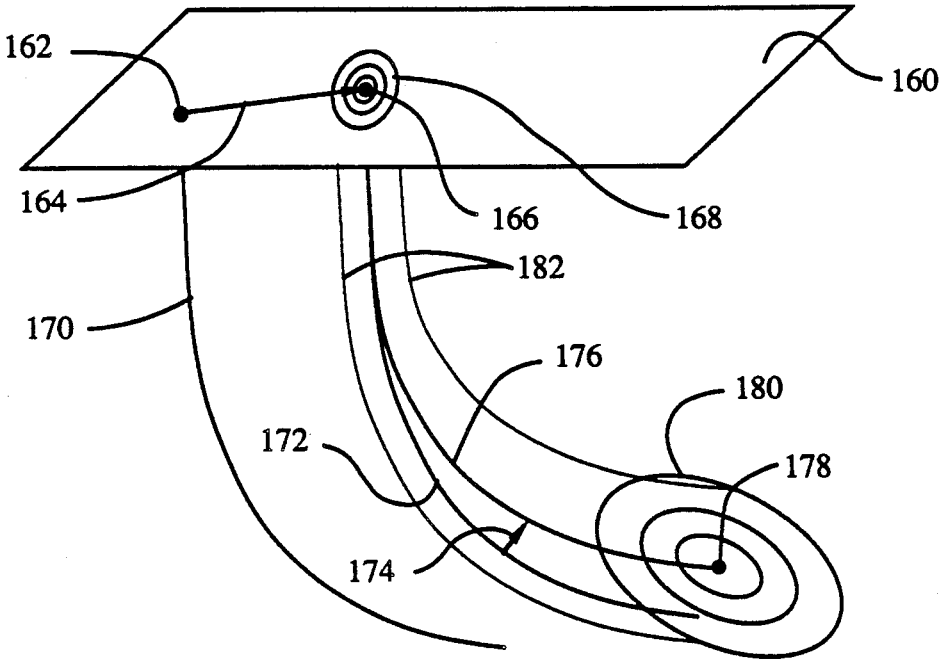
FIGS. 17*a–b* are illustrations of the parameters associated with probable location distributions and relative probable location distributions.
Figure 17B:
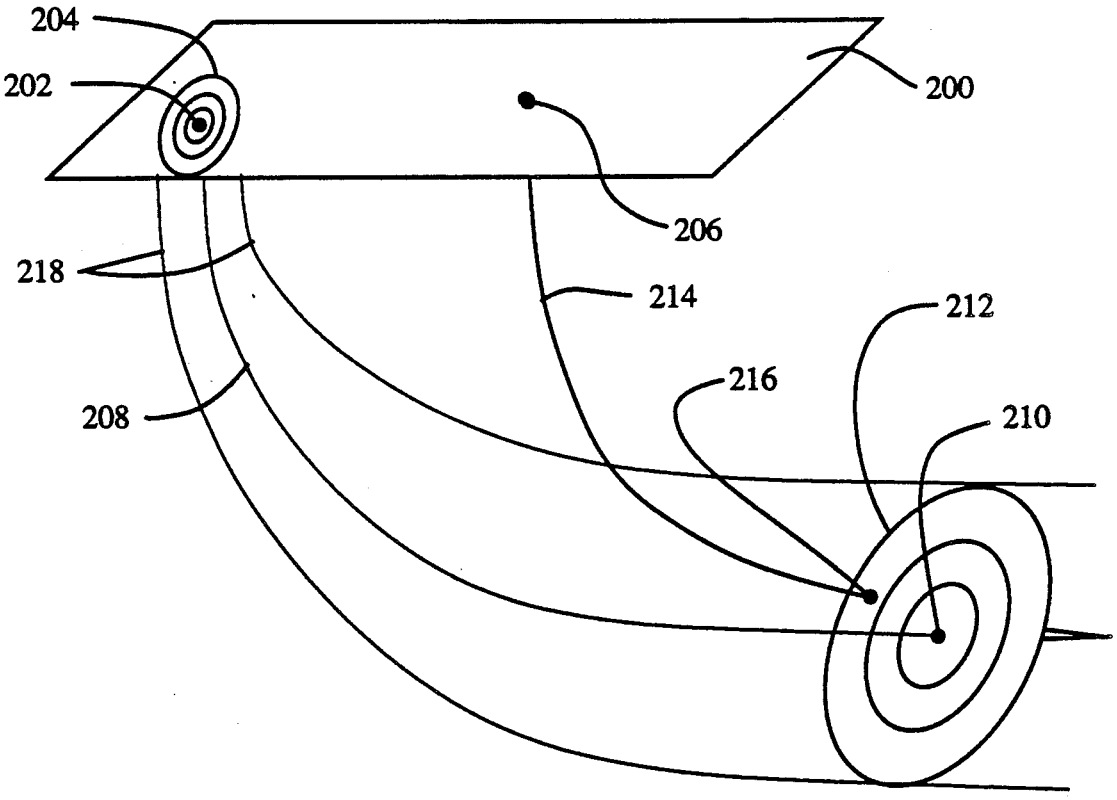

FIG. 17*a–b* illustrate the RPLD components and their relationships in three dimensions. FIG. 17*a* is for a single well where a surface plane, 160, is shown with the normal surface location, 162, the expected error of the surface location, 164, the expected surface location, 166, and the probable location distribution, or PLD, centered around the expected surface location, 166. All four quantities, 162, 164, 166, and 168 are properties of the surface location only. For example, the PLD, 168, reflects only the errors associated with the surface location of this one well. Beneath the surface, 160, extends the normal profile, 170, of the well from the normal surface location, 162. The word normal refers to the state-of-the-art operations. The well profile, 172, is the same normal profile extended from the expected surface location, 166. The well profile expected error, 174, shown at a single point, is used to correct the normal profile, 172, to the expected profile, 176. At a specific depth in the well, the expected location, 178, is a point on the expected profile, 176, and a PLD, 180, surrounds the expected location, 178, located at its center. A PLD envelope, 182, extends from the surface PLD, 168, to the PLD at depth, 180, continually growing in size as errors accumulate with depth. As graphically depicted, the PLD is a dynamic element whose size changes with depth. The total error of location at depth is the sum of the surface and profile errors and are necessarily treated separately.

FIG. 17*b* illustrates the RPLD components associated with two wells, typically, a blowout well and a relief well in a manner very similar to FIG. 17*a*. The RPLD, 204, is centered around the expected surface location, 202, of the blowout well in the surface plane, 200. The expected surface location of the relief well, 206, is also in the plane, 200. The blowout well expected location profile, 208, extends to depths from the expected surface location, 202, to an expected location, 210, at a specific depth at which the RPLD, 212, for that depth is shown. The relief well expected location profile, 214, extends to depths from the relief well expected surface location, 206, and its intersection with the RPLD at depth, 216, is shown. An envelope of the RPLD, 218, is shown extending from the surface RPLD, 204, through the RPLD at depth, 212. The RPLD at any depth represents all of the location errors associated with both the blowout and relief wells for both the surface and profile aspects. Typically, but not necessarily, the expected locations at depth represent removal of all expected errors.

SYSTEM BLOCK DIAGRAM

Figure 18:
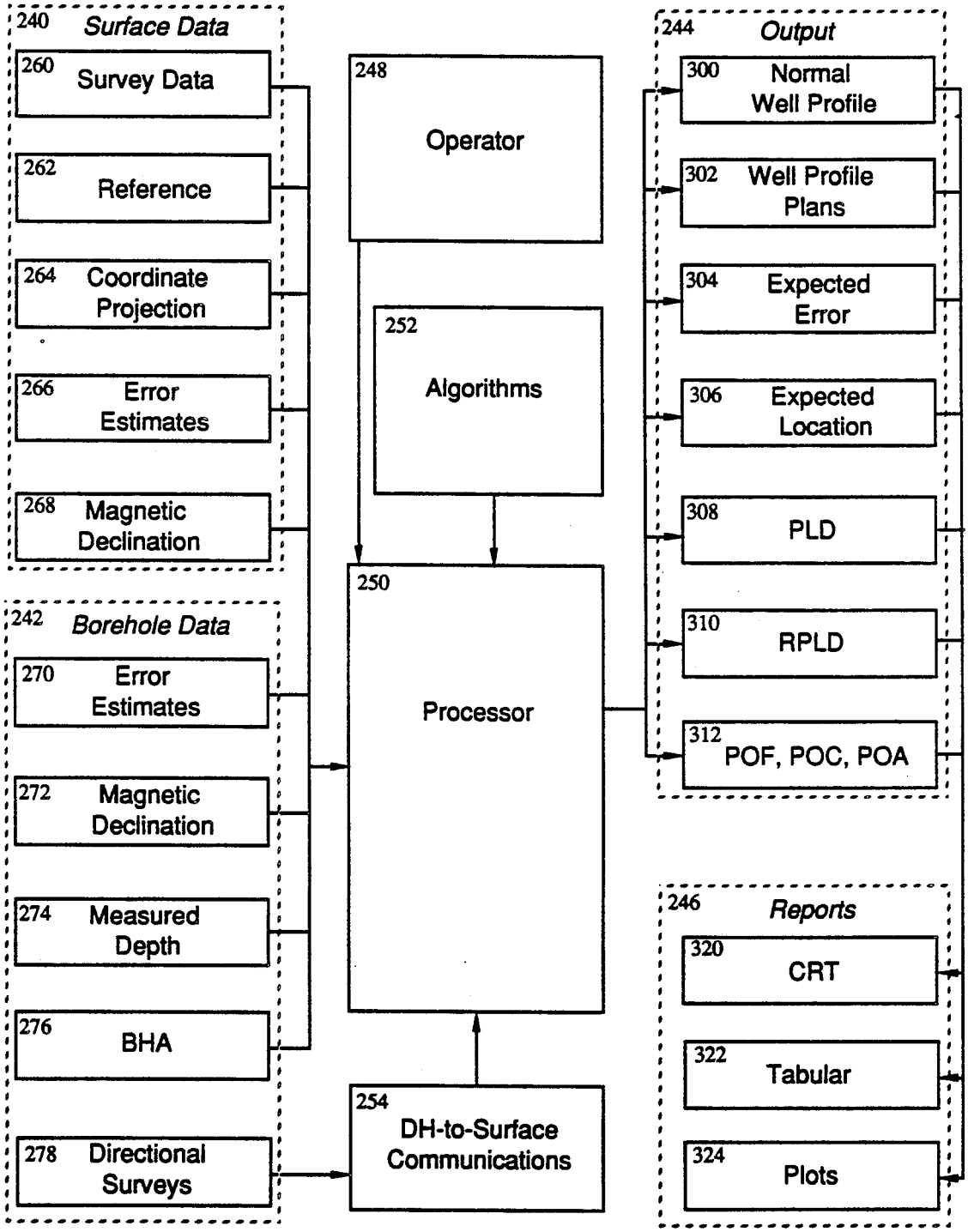
FIG. 18 is a block diagram of the data acquisition and processing system.

FIG. 18 is a block diagram of the data acquisition, processing and output system. The major blocks of the system are the surface location data input sensors, 240, the borehole location data input sensors, 242, the outputs, 244, the output reports, 246, the operator, 248, the processor, 250, the processing algorithms, 252, and the downhole-to-surface communications system, 254, commonly a commercial MWD system. The operator instructs the processor to select the proper algorithms for accomplishing the wanted routine such as acquiring data, processing the desired output and producing the desired report. The surface location data, 240, include survey data, 260, location reference data, 262, such as bench marks, established reference lines, and "big old oak tree landmarks", the coordinate projection system relating 3-D to 2-D, 264, estimates of the error of all data, 266, and the magnetic declination used in the surveys, 268. The borehole location data input, 242, include estimates of all the errors, 270, the magnetic declination used, 272, measured depth data, 274, complete bottom hole assembly specifications including magnetic, 276, and directional survey data, 278. The directional survey data, 278, are acquired downhole and must be communicated to the surface, 254, typically via a commercial MWD system. The output, 244, includes the normal (state-of-the-art) well profiles, 300, relief well profile plans, 302, the expected errors for the surface and borehole, 304, the expected locations for the surface and well profiles, 306, the component and composite PLDs, 308, the RPLD, 310, at any depth, and the integral probabilities, 312. The integral probabilities include the probability of find, the probability of collision and the probability of access. These outputs may be reports, 246, in the form of CRT display, 320, printed tabular data, 322, and graphic hard copy plots 324.

PROCESS CHART

Figure 19A:
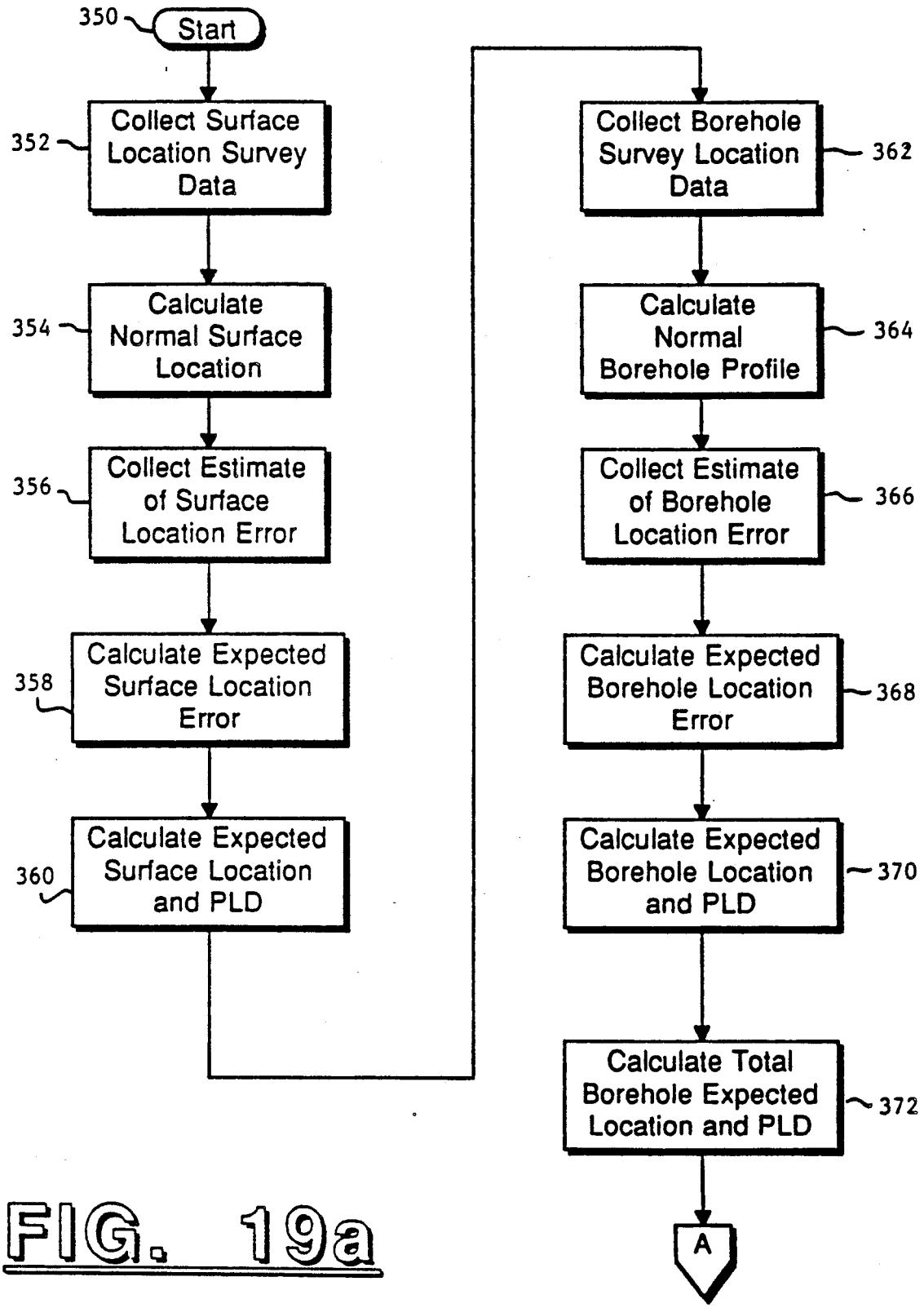
FIGS. 19*a–e* are flow charts of the process of data acquisition and processing.
Figure 19B:
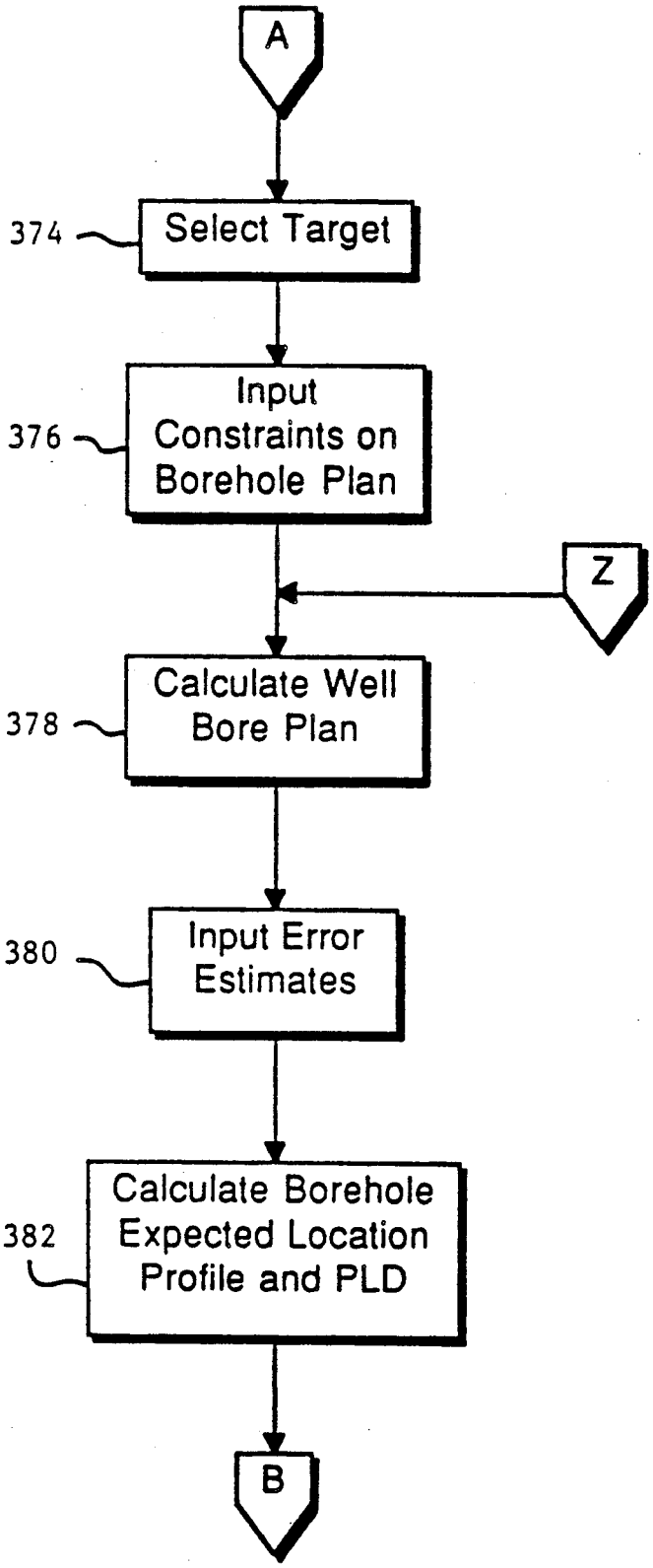
Figure 19C:
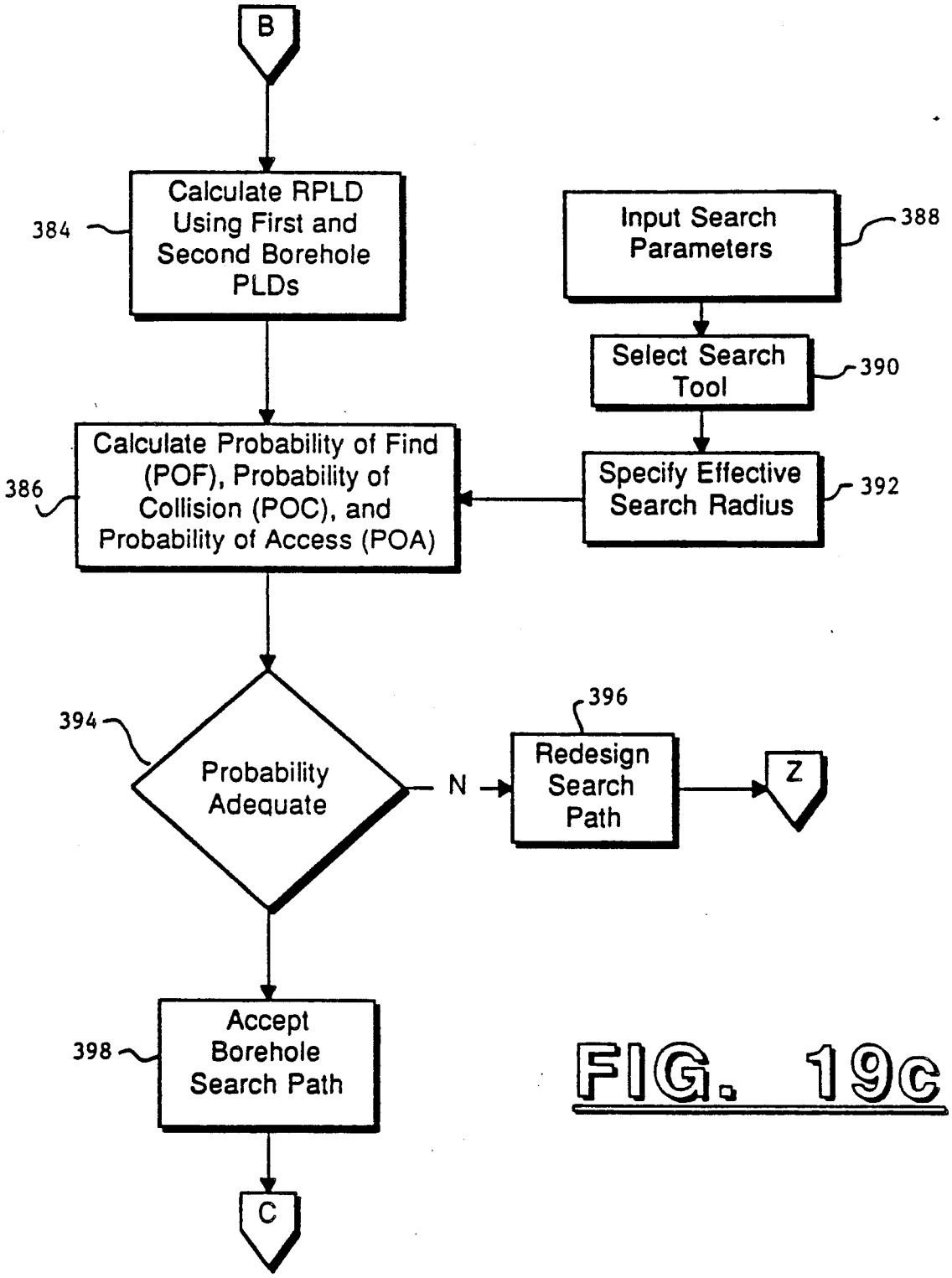
Figure 19D:
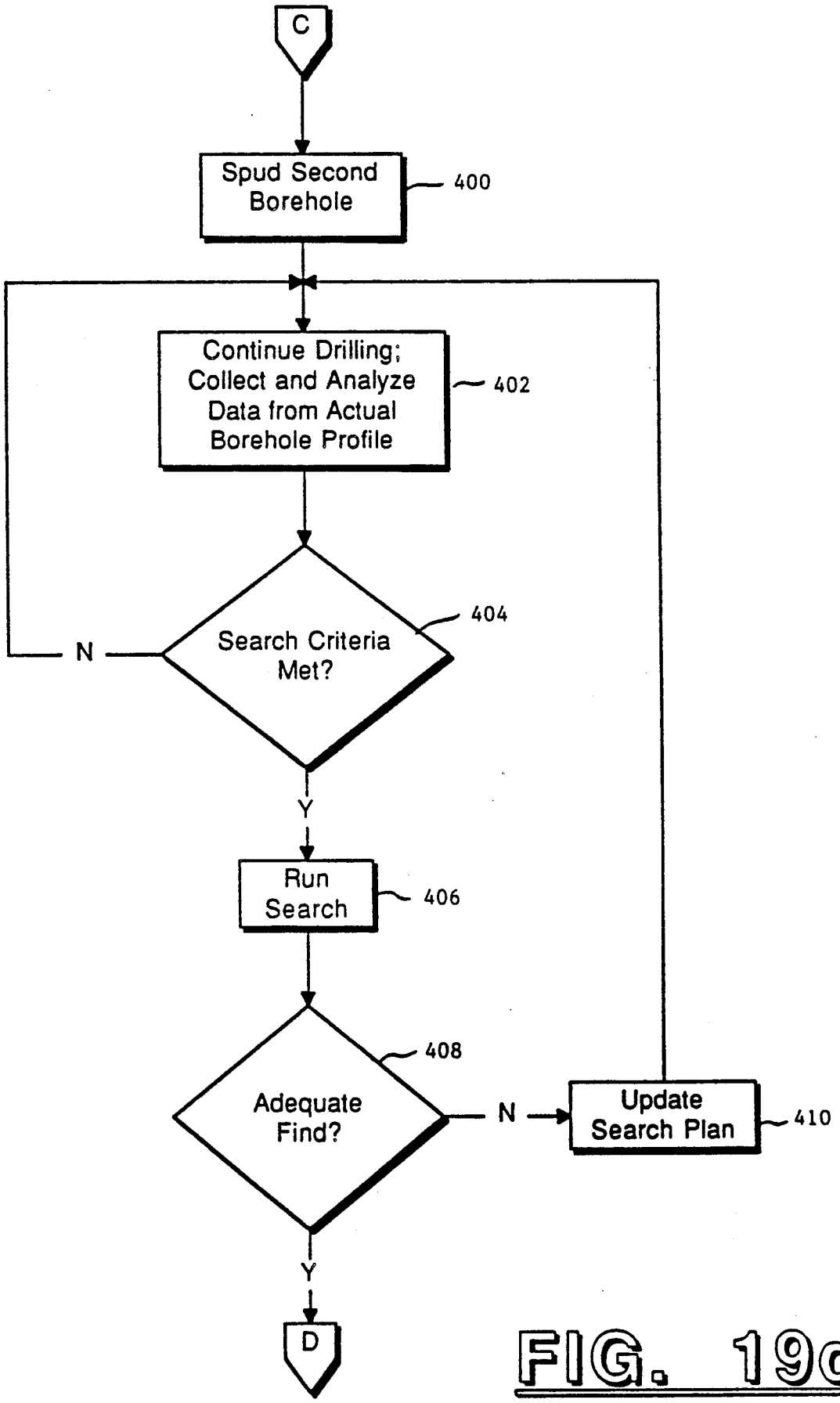
Figure 19E:
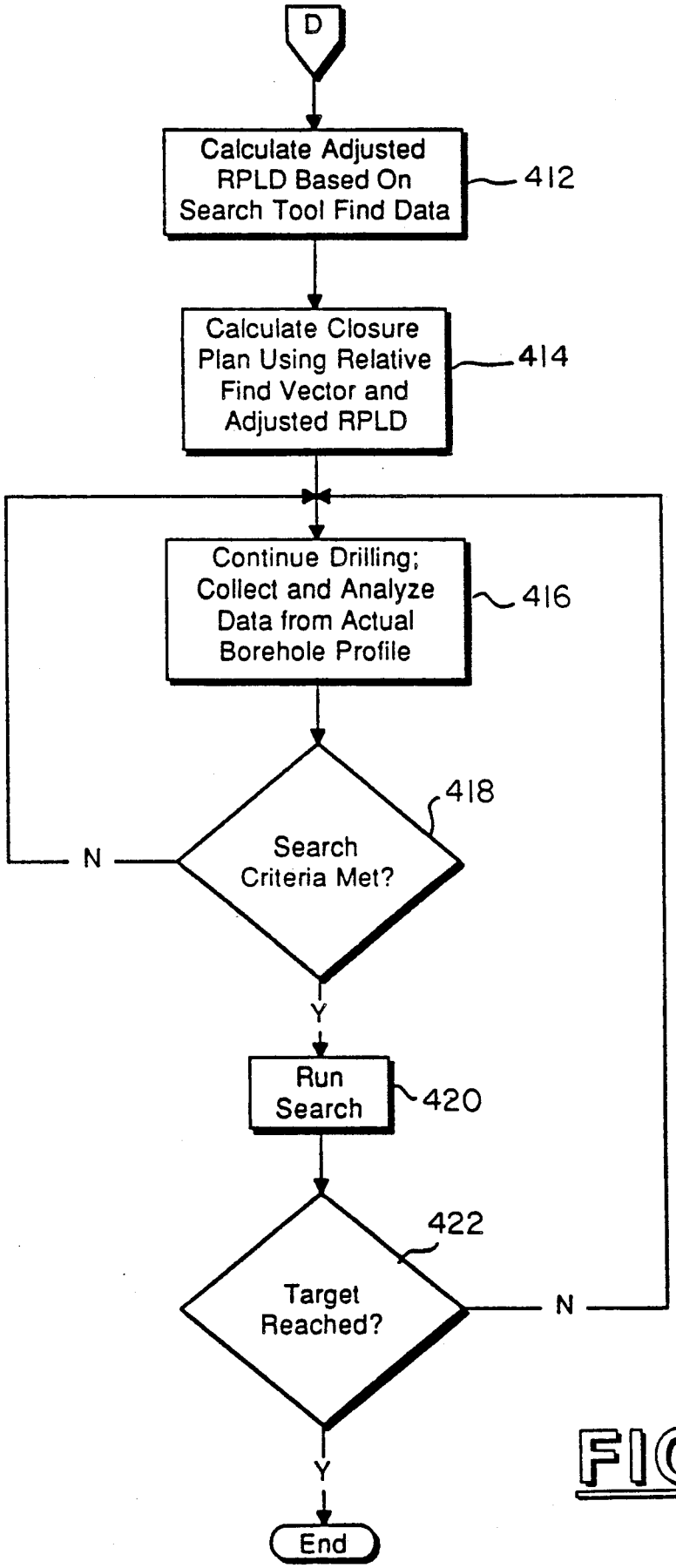

FIGS. 19*a–e* provide a process flow chart for practicing the method of the present invention. Each of these figures represents a major module of the software used to implement the invention system. FIGS. 19*a–b* provide details relating to the location of the first and second boreholes, respectively. FIG. 19*c* provides information relating to the implementation of the search plan, including the search tool parameters. FIG. 19*d* illustrates the processing steps relating to the search for the first borehole and, finally, FIG. 19*e* provides information relating to the processing steps for closure.

Referring to FIG. 19*a*, the system is started in step 350 and, in step 352 surface location survey data for the first borehole is collected and input into the system. In step 354, this data is used to calculate a normal surface location for the first borehole. Next, in step 356, surface location error data is input and, in step 358, an expected surface location error is calculated. The results calculated in steps 354 and 358 are used in step 360 to calculate an expected surface location and probable location distribution (PLD). In step 362, borehole survey data is collected and processed in step 364 to calculate a normal borehole profile. In step 366, borehole survey error data is input into the system and processed in step 368 to calculate the expected borehole location error. In step 370, the results calculated in step 364 and 368 are used to calculate the expected borehole location profile and probable location distribution for the profile. In step 372, the results calculated in steps 360 and 370 are combined to calculate the total borehole expected location profile and probable location distribution. This result will be used as an input into the relative probable location distribution (RPLD), discussed in greater detail below.

In step 374, a target is selected, such as an intersection point on the first borehole. In step 376, the constraints on the borehole plan are entered into the system. Common examples of such constraints include possible surface locations, weather and drilling conditions, and blow out well hazards. The borehole plan is calculated in step 378 and an estimate of location errors is input in step 380. In step 382, the expected borehole location profile and the probable location distribution is calculated for the second borehole. One of the possible inputs into the borehole plan for the second borehole is a redesigned search path calculated in step 396, as discussed below.

Referring to FIG. 19*c*, in step 384 the results calculated in steps 372 and 382 are used to calculate the location profiles of the first and second boreholes and their RPLD. These PLDs and the RPLD are illustrated in FIG. 15*a–15b*. In step 386, three separate integral probabilities are calculated. The probability of find, POF, the probability of collision, POC, and the probability of access, POA. One of the major inputs for this calculation is information relating to the search tool. This information input is illustrated in steps 388–392, including input of the search parameters in step 388, including well tubular sizes and properties, formation resistivity, drilling mud properties and search tool characteristics. These parameters are processed to select an optimum search tool in step 390, and to specify its effective search radius in step 392. The other major input into the calculation of probabilities is the profile information and RPLD calculated in step 384. In step 394, the probabilities calculated in step 386 are analyzed to determine whether the probabilities are adequate. If the probabilities are not adequate, the search plan is redesigned in step 396 and the system returns to step 378 as illustrated in FIG. 19*b*. However, if the probability parameters have been satisfied in step 394, the borehole search plan is accepted in step 398.

The results calculated in step 398 are used in the search module which provides a means for drilling the second borehole according to a plan which ensures a successful find of the first borehole. Once a borehole search path has been accepted, the second borehole is initiated as represented by step 400 in FIG. 19*d*, wherein the plan is used to spud the second borehole. Drilling is continued according to the plan in step 402 as data is collected and analyzed to yield the actual relief well profile with currently evaluated RPLD and the probabilities POF, POC, and POA. In step 404, a determination is made of whether the search criteria have been met. If the search criteria have not been met the processing returns to step 402 and drilling and analysis of the data continues. However, if the search criteria have been met, a search is made in step 406 and a decision is made in step 408 of whether the search has yielded an adequate "find." If an adequate find has not been made, the processing proceeds to step 410 where the search plan is updated and the system returns to step 402 to continue the drilling and analysis of data relating to the actual borehole profile. However, if a determination is made that an adequate find has occurred, the processing proceeds to the "closure" module shown in FIG. 19*e*.

Referring to FIG. 19*e*, the data processing for the closure module begins in step 412, wherein the relative probable location distribution and associated components are adjusted based on data obtained during the search tool find. The search data specify a relative find vector, RFV, and associated RPLD. This RFV associated RPLD could be referred to as a relative find probable location and distribution. The RFV is a displacement vector which specifies the relative location between the two boreholes and the relative probable location distribution as a function of the error associated with the find. A more precise term for this "adjusted" RPLD could be "relative find probable location and distribution." This quantity is unrelated to the previous RPLD. Rather, the new RPLD is generally smaller than the original RPLD. The RFV and the new RPLD are used in step 414 to calculate a closure plan. In this processing, the profile of one or both boreholes is adjusted to accommodate the RFV and a new borehole plan is calculated to close on the target in an optimum manner as described in the closure description. In step 414, the closure plan is calculated using the relative find vector and the adjusted RPLD. Drilling is continued as indicated in step 416, while data are acquired and processed in accordance with the actual borehole profile. In step 418, a determination is made of whether the search criteria have been met. If the criteria have not been met, the processing returns to step 416 and the drilling an analysis steps are continued. However, if it is determined that the search criteria have been met, then a new search is conducted in step 420. The new RFV and RPLD resulting from this search as are used as an input to the RPLD adjustment in step 412. In step 422, a decision is made of whether the target has been reached. If the target has not been reached, the processing returns to step 416 and continues with the aforementioned processing steps. However, if it is determined that the target has been reached, then the processing is ended.

CLOSURE

Figure 10:
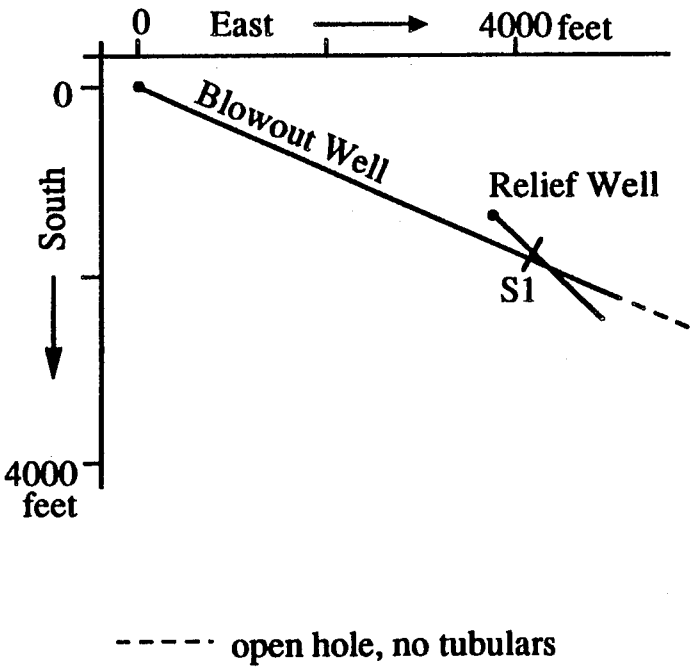
FIG. 10 is an illustration of a plan view showing the well profiles of a blowout wellbore and a relief wellbore in a horizontal plane.
Figure 9:
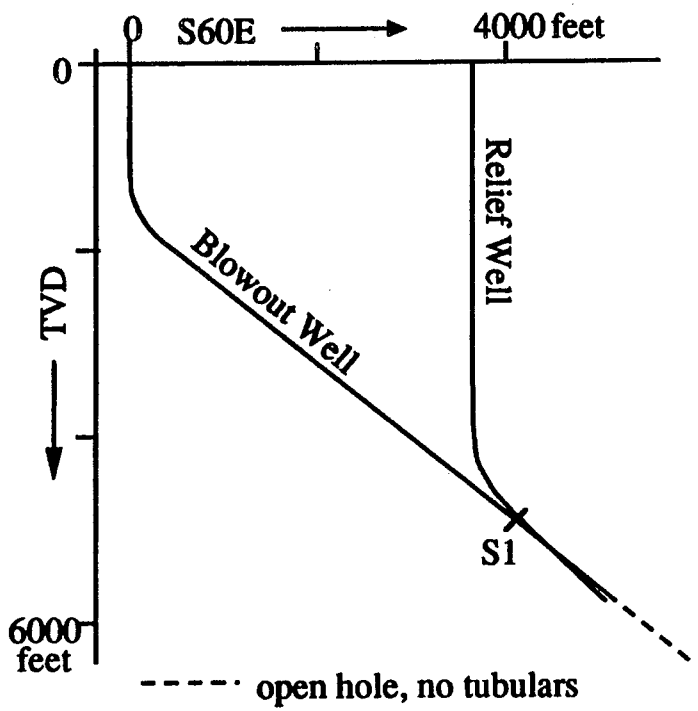
FIG. 9 is an illustration of a vertical section showing the well profiles of a blowout wellbore and a relief wellbore in a vertical plane.

A vertical section of a deviated blowout well is shown in FIG. 9. The blowout well was drilled straight for about 1500 feet and then angle was built to an inclination of about 45° in the direction South 60° East. The 45° inclination was held to a TVD of 5800 feet and casing was set. The well was then drilled to 6200 feet TVD. A blowout occurred while the drill string was out of the hole leaving open hole below the casing set at 5800 feet TVD. A vertical section of the blowout well in shown in FIG. 9. A plan view of the blowout well is shown in FIG. 10. A near optimum relief well plan with an efficient search path is also shown in FIG. 9 and FIG. 10.

A zoom Compare View of the two wells is shown in FIG. 11. The blowout well is chosen as the reference well which is always shown at the center (crossing of the high and right axes). This zoom compare view is a composite of seven compare view planes at the seven successive depths in the blowout well. The relief well is shown as a small circle plotted at the crossing of the relief well in the compare view plane; seven circles are shown, one for the crossing at each of the seven depths. The circle labeled depth 1 represents the relief well crossing in the shallowest compare view plane, the next deeper plane crossing is labeled depth 2, etc. It is instructive to imagine looking straight at FIG. 11, which is the same as looking straight along the blowout well borehole, and visualizing, in animated fashion, perpendicular planes (compare views) at successive depths. In so doing, the relief well crossings are seen to start in the upper left corner at depth 1 and progress down and left to right as represented by the progressive depth labels all the way to the label, depth 7. The relief well sweeps through the compare view. This relatively small section of the relief well is called the search path and is the portion of the relief well over which searches for the blowout well are conducted.

During the planning of a relief well, designs are iterated until one is found which optimizes the speed, ease and safety of drilling and achieves high probabilities of find, access, and intercept and low probability of collision. Generally, it is highly desirable to minimize the size and control the shape of the RPLD to permit a high probability of find. It is often important to plan the relief well to minimize the size of the RPLD in one direction and plan the search path to sweep along the longer axis of the RPLD which maximizes the probability of find with minimum searching.

Such an optimized RPLD is shown in FIG. 11 as represented by the three ellipses which have the values of 1, 2, and 3 $\sigma$ (standard deviation). Note that the search path of the relief well is along the long axis of the RPLD to maximize the probability of find.

The preplanned first search point is at depth 4 and labeled S1 (first search). The radius of the search tool around S1 is shown by the arrow labeled R. The relief well is drilled without hesitation as quickly as possible to the preselected position S1 and a search is run. The integral probability of find to S1 is approximately 65% as obtained by integrating the probability density function (of the RPLD) over the searched area shown inside the curve labeled search area boundary.

Assume an adequate find was made (65% chance) and that the find is specified as a Relative Find Vector, RFV, in the compare view plane. The RFV is a displacement vector (magnitude and direction) which has an expected value and a random error, both which must be specified. The error is two dimensional in the compare view plane and can be specified by a covariance matrix or, alternately, by the magnitudes of the two semi-major axes of the ellipse and its orientation angle. The error specification is essential to quantitative closure procedures. The prior art specifies only the expected value of the find vector and this value is evaluated generally in terms of the plan view.

The RFV is shown in FIG. 11 extending to the blowout well from a position labeled F1. F1 is the adjusted location of the relief well which is compatible with the find. A position F1B is also shown which is the blowout position required to be compatible with the find and the relief well position. In the compare view it is desirable to use the F1 concept and adjust all relief wells to the referenced blowout well.

The actual translation or modification of the well profiles to accommodate the RFV in the compare view is a big and important issue. The simplest operation is to translate the surface location of the relief well even though this is the least likely event to be actually true. The more probable criteria is to systematically adjust the inclination and azimuth values in the blowout well because these are the quantities most likely in error. In practice, it is important to adjust the parameters most likely in error to improve the probability that projections of the wells ahead from the find point are as accurate as possible.

Figure 13:
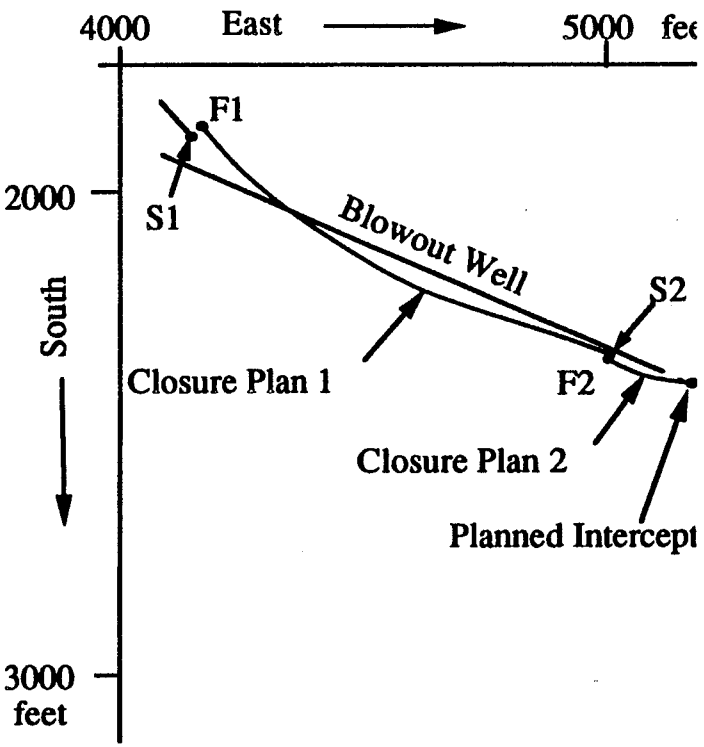
FIG. 13 is an illustration of an expanded view of the plan view showing the well profiles of a blowout wellbore and a relief wellbore in a horizontal plane.
Figure 12:
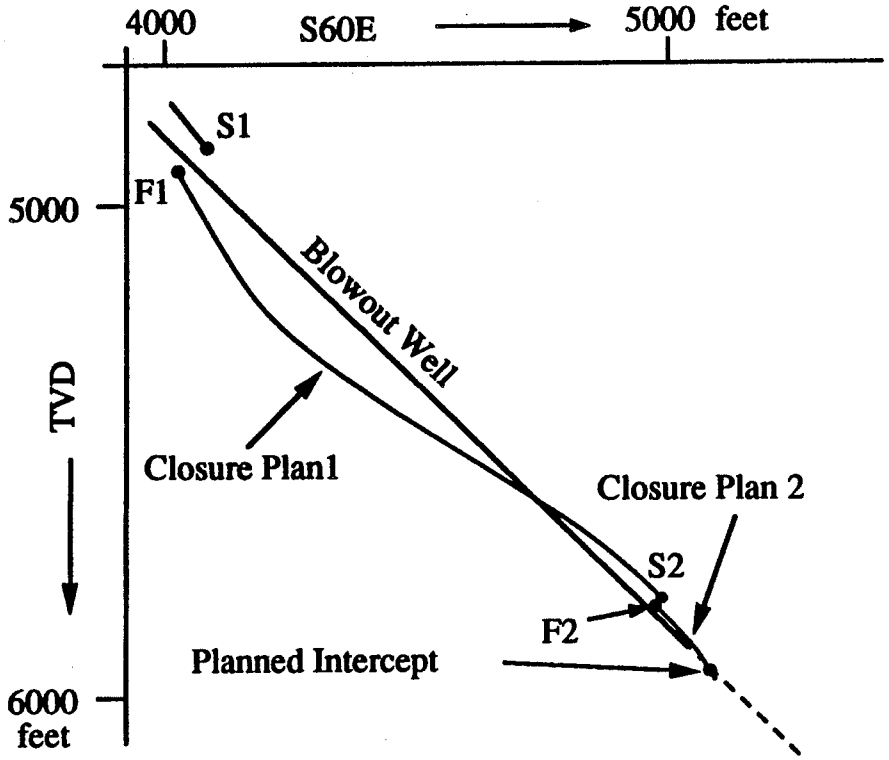
FIG. 12 is an illustration of an expanded view of the vertical section showing the well profiles of a blowout wellbore and a relief wellbore in a vertical plane.

FIG. 12 is an expanded vertical section and FIG. 13 is an expanded plan view of the closure and intercept region of the drilling operation. In both views, S1 and F1 are the same locations as shown in FIG. 11. In FIGS. 14*a–d* the compare views are shown at a scale of 50 ft/inch as opposed to 100 ft/inch in FIG. 11.

Figure 14A:
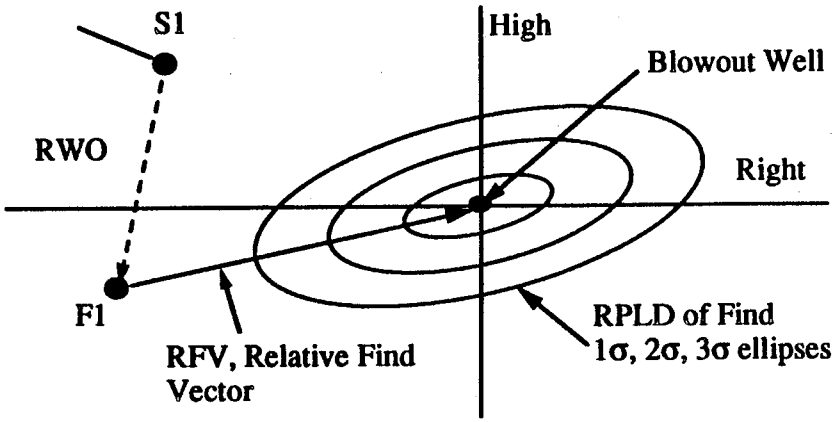
FIGS. 14*a–d* are illustrations of compare views of the relative probable location distribution at various depths.
Figure 14B:
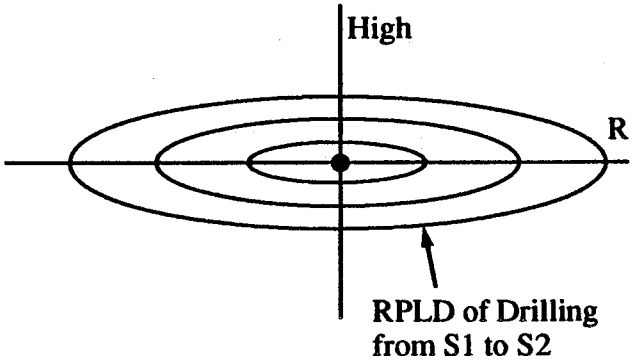

In FIG. 14*a* the first search position S1 of the relief well is shown, the relief well offset, RWO, required to position the relief well at position F1 is shown, and the RFV expected value is shown. At this point, the RPLD is described solely by the estimated error in the find vector. The RPLD of the find is shown in FIG. 14*a* as represented by the 1, 2, and 3 $\sigma$ (standard deviation) ellipses.

Figure 14C:
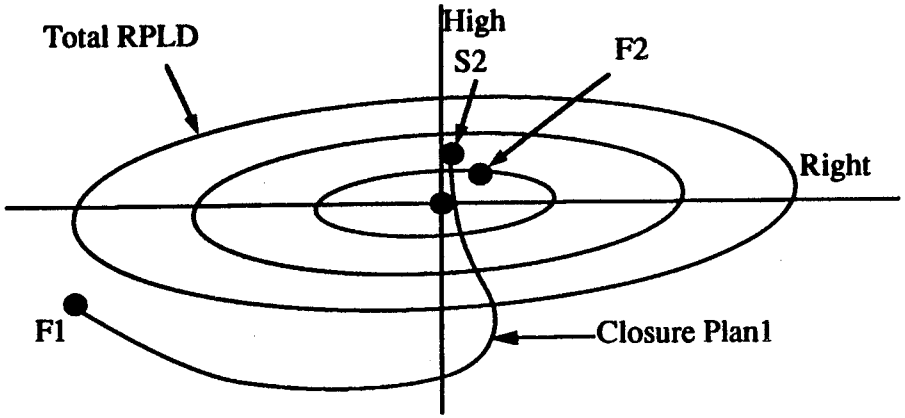

A closure relief well plan, Closure Plan 1, is made to optimize the time and risk to the intercept and kill of the blowout well. Closure Plan 1 is shown in FIGS. 12, 13, and 14*c*. Close inspection of all three figures, especially FIG. 14*c*, will show how the relief well path is planned to pass close around (270° ) the blowout well. This crossing greatly enhances the accuracy of the search tool and results in a desirably small RPLD of Find. At S2 the relief well direction is planned to be substantially the same as the blowout well which will make the next closure to intercept very easy. With the relief well plan made, the RPLD of drilling ahead from point F1 to S2, the second preplanned search point, is calculated and shown in FIG. 14*b*. The total RPLD at search point S2 is the combination of the RPLD of find at S1 and the RPLD of drilling from F1 to S2 and is shown in FIG. 14*c*. The RPLD at S2 represents the error in the relative location of the relief and blowout wells when the relief well is drilled to position S2 where the second search is made.

The relief well is drilled ahead along Closure Plan 1 to the position S2 where a second search is run. The probability of find is greater than 99%. An adequate find is assumed to be made and the expected location of the relief well is established at F2. F2 is established by the RFV expected value which extends from F2 to the blowout (not shown).

Figure 14D:
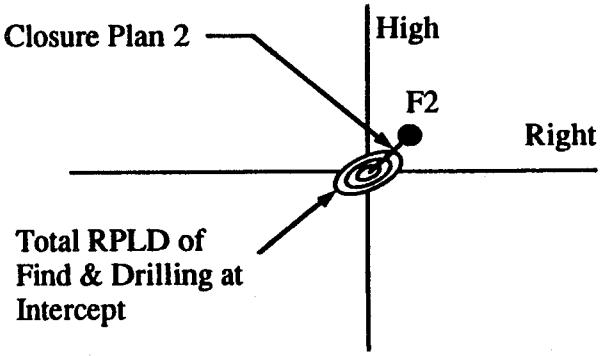

FIG. 14*d* shows the expected relative position of the relief well at position F2. The total RPLD, the combination of the RPLD of find at S2 (search 2) and the RPLD of drilling ahead along Closure Plan 2, is shown along with the Closure Plan 2. Closure Plan 2 is also shown in FIGS. 12 and 13.

Closure Plan 2 has a high probability of intersecting the blowout well approximately 50 feet below the end of the casing in the blowout well. The probability of "geometric collision" as determined by the probability of collision calculation is approximately 50%. This means that the relief well has a high probability of actually drilling directly into the blowout. Another important factor is that when the relief well is drilling essentially parallel and very close to the blowout, the relief well will have a great tendency to be drawn into the blowout borehole due to the weakened rock around the blowout due to the presence of the borehole and the reduced pressures on the rock.

It is important to note that only two search runs were made to achieve this high probability of intercept. Typically, the state-of-the-art requires many searches, upwards of 10 to 20. Each search not run saves typically a day of time in an operation where the monetary costs are sometimes millions of dollars per day. The costs in the form of pollution, loss of reserves and loss of life, although very real and large, are difficult to quantify.

While the method and apparatus of the present invention has been described in connection with the preferred embodiment, it is not intended to be limited to the specific form set forth herein, but on the contrary, it is intended to cover such alternatives, modifications and equivalents as may be reasonably included within the spirit and scope of the invention as defined by the appended claims.

What is claimed is:

1. A system for drilling a second wellbore along a planned path with respect to a first wellbore, comprising:

means for drilling said second wellbore;

means for obtaining survey data relating to the wellbore surface location and the borehole path of said first and second wellbores, respectively;

data processing means for: 1) calculating first and second sets of error coefficients for said survey data for said first and second boreholes, respectively, 2) using said error coefficients to calculate a relative probable location distribution describing the location of said first wellbore relative to the location of said second wellbore at successive depths; and 3) generating a path plan, using said relative probable location distribution, for drilling said second wellbore relative to said first wellbore; and control means to cause said drilling means to drill said second wellbore in accordance with said path plan.

2. The system according to claim 1, said data processing means further being operable to use said relative probable location distribution at said successive depths to calculate an integral probability of find for each said depth, said integral probability of find being the probability of locating said first wellbore using a search tool in said second wellbore, said data processing means further being operable to update said path plan using said integral probability of find to drill said second wellbore along a desired path with respect to said first wellbore.

3. The system according to claim 1, said data processing means further being operable to use said relative probable location distribution at said successive depths to calculate an integral probability of collision for each said depth, said data processing means further being operable to update said path plan using said integral probability of collision to drill said second wellbore along a desired path with respect to said first wellbore.

4. The system of claim 1 wherein said first set of error coefficients calculated by said data processing means includes random errors associated with said survey data for said first wellbore.

5. The system of claim 1 wherein said first set of error coefficients calculated by said data processing means includes systematic errors associated with said survey data for said first wellbore.

6. The system of claim 1 wherein said first set of error coefficients calculated by said data processing means includes both random and systematic errors associated with said survey data for said first wellbore.

7. The system of claim 2 wherein said integral probability of find is calculated by said data processing means by dividing said relative probable location distribution into probability sectors and summing the probability of said sectors of said distribution which are included in the searched path of the second wellbore.

8. The system of claim 2 wherein said integral probability of find is calculated by said data processing means by dividing the search path into a plurality of units and summing the probability of said units, with the probability of each unit being equal to the probability density evaluated at the center of the unit multiplied by the area of the unit.

9. A method of drilling a second wellbore along a planned path with respect to a first wellbore, comprising the steps of:

collecting survey data relating to the borehole path of said first wellbore;

determining a first set of error coefficients for said survey data for said first wellbore;

using said first set of error coefficients to calculate a probable location distribution describing the location of said first wellbore at successive depths; and using said probable location distribution to drill said second wellbore along a planned path relative to said first wellbore.

10. The method of claim 9 wherein said first set of error coefficients includes random errors associated with said survey data for said first wellbore.

11. The method of claim 9 wherein said first set of error coefficients includes systematic errors associated with said survey data for said first wellbore.

12. The method of claim 9 wherein said first set of error coefficients includes both random errors and systematic errors associated with said survey data for said first wellbore.

13. The method according to claim 9, further comprising the steps of:

collecting survey data relating to the borehole path of said second borehole;

determining a second set of error coefficients for said survey data for said second wellbore;

using said first and second sets of error coefficients to calculate a relative probable location distribution describing the location of said first wellbore relative to the location of said second wellbore at successive depths;

using said relative probable location distribution at said successive depths to calculate an integral probability of find for each said depth, said integral probability of find being the probability of locating said first wellbore using a search tool in said second wellbore; and using said integral probability of find to drill said second wellbore along a desired path with respect to said first wellbore.

14. The method according to claim 9, further comprising the steps of:

collecting survey data relating to the borehole path of said second borehole;

determining a second set of error coefficients for said survey data for said second wellbore;

using said first and second sets of error coefficients to calculate a relative probable location distribution describing the location of said first wellbore relative to the location of said second wellbore at successive depths;

using said relative probable location distribution at said successive depths to calculate an integral probability of collision for each said depth; and using said integral probability of collision to drill said second wellbore along a desired path with respect to said first wellbore.

15. The method of claim 9 wherein said survey data includes data relating to the surface location of said first wellbore.

16. The method of claim 15 wherein said survey data includes data relating to the survey source errors related to the measured path of said first wellbore.

17. The method of claim 13 wherein said step of calculating said integral probability of find further comprises the step of dividing said relative probable location distribution into probability sectors and summing the probability of said sectors of said distribution which are included in the searched path of the relief wellbore.

18. The method of claim 13 wherein said step of calculating said integral probability of find further comprises the step of dividing the search path into a plurality of units and summing the probability of said units with the probability of each unit being equal to the probability density evaluated at the center of the unit multiplied by the area of the unit.

19. The method of claim 13 or 14, further comprising the step of calculating an expected location of said first wellbore by removing expected errors from said first and second data sets.

20. A method of drilling a second wellbore along a planned path with respect to a first wellbore, comprising the steps of:

collecting survey data relating to the first wellbore surface location and the borehole path of said first wellbore;

determining a first set of error coefficients for said survey data for said first wellbore;

collecting survey data relating to the second wellbore surface location and the borehole path of said second wellbore;

determining a second set of error coefficients for said survey data for said second wellbore;

using said first and second sets of error coefficients to calculate a relative probable location distribution describing the location of said first wellbore relative to the location of said second wellbore at successive depths; and using said relative probable location distribution to drill said second wellbore along a planned path relative to said first wellbore.

21. The method according to claim 20, further comprising the steps of:

using said relative probable location distribution at said successive depths to calculate an integral probability of find for each said depth, said integral probability of find being the probability of locating said first wellbore using a search tool in said second wellbore; and using said integral probability of find to drill said second wellbore along a desired path with respect to said first wellbore.

22. The method according to claim 20, further comprising the steps of:

using said relative probable location distribution at said successive depths to calculate an integral probability of collision for each said depth; and using said integral probability of collision to drill said second wellbore along a desired path with respect to said first wellbore.

23. The method of claim 20 wherein said first and second sets of error coefficients include random errors associated with said survey data for said first and second wellbore.

24. The method of claim 20 wherein said first and second sets of error coefficients include systematic errors associated with said survey data for said first and second wellbore.

25. The method of claim 20 wherein said first and second sets of error coefficients include both random and systematic errors associated with said survey data for said first and second wellbores.

26. The method of claim 21 wherein said step of calculating said integral probability of find further comprises the step of dividing said relative probable location distribution into probability sectors and summing the probability of said sectors of said distribution which are included in the searched path of the relief wellbore.

27. The method of claim 21 wherein said step of calculating said integral probability of find further comprises the step of dividing the search path into a plurality of units and summing the probability of said units, with the probability of each unit being equal to the probability density evaluated at the center of the unit multiplied by the area of the unit.

28. The method of claim 20, further comprising the step of calculating the expected locations of said first and second wellbores by removing expected errors from said first and second data sets.

* * * * *